US010723126B2

(12) United States Patent
Nakatsuji et al.

(10) Patent No.: US 10,723,126 B2
(45) Date of Patent: Jul. 28, 2020

(54) INKJET RECORDING APPARATUS AND CONTROL METHOD THEREFOR

(71) Applicant: KYOCERA Document Solutions Inc., Osaka (JP)

(72) Inventors: Hiroomi Nakatsuji, Osaka (JP); Naoko Kawashima, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/366,772

(22) Filed: Mar. 27, 2019

(65) Prior Publication Data

US 2019/0299605 A1 Oct. 3, 2019

(30) Foreign Application Priority Data

Mar. 30, 2018 (JP) ..... 2018-068691
Mar. 8, 2019 (JP) ..... 2019-042997

(51) Int. Cl.

| | |
|---|---|
| ***B41J 2/045*** | (2006.01) |
| ***B41J 2/21*** | (2006.01) |
| ***B41J 29/38*** | (2006.01) |
| ***B41J 2/155*** | (2006.01) |

(52) U.S. Cl.

CPC ..... *B41J 2/04573* (2013.01); *B41J 2/04505* (2013.01); *B41J 2/155* (2013.01); *B41J 2/2146* (2013.01); *B41J 29/38* (2013.01)

(58) Field of Classification Search

CPC .... B41J 2/04573; B41J 2/04505; B41J 2/155; B41J 29/38; B41J 2/2146; B41J 2/2135; B41J 11/008; B41J 2/01

USPC ..... 347/14

See application file for complete search history.

(56) References Cited

U.S. PATENT DOCUMENTS

2014/0285828 A1* 9/2014 Enge ..... B41J 2/2135 358/1.8

FOREIGN PATENT DOCUMENTS

JP 2015-58677 A 3/2015

* cited by examiner

*Primary Examiner* — Huan H Tran
*Assistant Examiner* — Alexander D Shenderov
(74) *Attorney, Agent, or Firm* — Stein IP, LLC

(57) ABSTRACT

An inkjet recording apparatus includes a sheet conveying unit, a storage unit, a line head, and a control unit. The line head includes an upstream-side head and a downstream-side head. The upstream-side and downstream-side heads are fitted to have overlapping portions in which a plurality of nozzles arranged in respective end portions of the heads overlap as seen from the sub scanning direction. When an adjustment chart is printed, the control unit makes the nozzles in the overlapping portion of the upstream-side head print a first line. The control unit makes the nozzles in the overlapping portion of the downstream-side head print a second line.

10 Claims, 12 Drawing Sheets

INKJET RECORDING APPARATUS AND CONTROL METHOD THEREFOR

INCORPORATION BY REFERENCE

This application is based upon and claims the benefit of priority from the corresponding Japanese Patent Application No. 2018-068691 filed on Mar. 30, 2018, and Japanese Patent Application No. 2019-042997 filed on Mar. 8, 2019 the entire contents of which are incorporated herein by reference.

BACKGROUND

The present disclosure relates to inkjet recording apparatuses, that is, recording apparatuses that perform printing by ejecting ink from nozzles.

Printing apparatuses that use ink are known. Such a printing apparatus includes a recording head. The recording head includes a plurality of nozzles. Based on image data, ink is ejected from the recording head onto a sheet. During the assembly of the printing apparatus, the fitting position of the recording head can deviate from the ideal position. A deviation in the fitting position results in a deviation in the landing position of ink. This can result in a color displacement. A technology for coping with a deviation in the fitting position of a recording head is known, as will be described below.

Specifically, a known inkjet recording apparatus is configured as follows. A plurality of recording heads, each having a plurality of nozzles arrayed at predetermined intervals, are arranged in a staggered formation in the nozzle array direction. There is a joint portion where a plurality of nozzles arranged in respective end parts of adjacently arranged recording heads overlap in the direction perpendicular to the nozzle array direction. A plurality of recording head units are arranged in the direction perpendicular to the nozzle array direction. Input image data is converted into ejection image data for each recording head unit. While a recording medium is being conveyed, ink is ejected from the nozzles of the plurality of recording heads according to the ejection image data to form an image. Based on measurement image data for forming a predetermined measurement image at a pixel position determined beforehand for each recording head, the plurality of recording head units are each made to form the measurement image. Errors in image formation position among the recording head units as identified from the measurement images formed by the plurality of recording head units respectively are identified for each recording head. From the error identified for each recording head, a corrected position for the ejection image data is determined so as to correspond to each recording head. An image is inserted or deleted at the determined corrected position to correct the ejection image data. This configuration is aimed at reducing a color displacement resulting from fitting with a deviation in the nozzle array direction.

In an inkjet recording apparatus, a plurality of recording heads are often arranged in a staggered formation in the main scanning direction (nozzle array direction). A plurality of recording heads are combined into a line head for one color. This helps increase the width of printable sheets. Such line heads have recording heads located at different positions in the sub scanning direction (sheet conveying direction). On the other hand, for a given line, printing positions have to be aligned in the sub scanning direction. Accordingly, for a given line, the timing of ink ejection at a downstream-side recording head is delayed, by a wait time, from that at an upstream-side recording head. The wait time is determined beforehand. For example, the wait time is determined based on the time calculated by dividing the specification-stated (designed) distance from the upstream-side recording head to the downstream-side recording head by the specification-stated sheet conveying speed.

In an inkjet recording apparatus, the size of one pixel (one dot) is extremely small. It is difficult to fit a recording head at an ideal position with no deviation as large as one pixel. Thus, the fitting position of a recording head can deviate from the specification-stated position (ideal position) in the sub scanning direction. A deviation in the fitting position of a recording head in the sub scanning direction can, inconveniently, lead to degraded image quality. For example, a deviation in the landing position of ink in the sub scanning direction can lead to degraded image quality. For example, a deviation from the intended position can produce a color that does not originate from the original (color displacement). To correct a color displacement requires accurately recognizing the amount and the direction of deviation in printing position.

The conventionally known technology mentioned above addresses a deviation in the fitting position of a recording head in the nozzle array direction (main scanning direction); it does not cope with a deviation in the fitting position of a recording head in the sub scanning direction, and thus does not give a solution to the inconvenience mentioned above.

SUMMARY

According to one aspect of the present disclosure, an inkjet recording apparatus includes a sheet conveying unit, a storage unit, a line head, and a control unit. The sheet conveying unit conveys a sheet. The storage unit stores a first offset time. The line head ejects ink onto the sheet conveyed by the sheet conveying unit, thereby to perform printing. The control unit controls the ejection of ink from the line head. The line head includes an upstream-side head and a downstream-side head. The upstream-side head is located on the upstream side of the downstream-side head in the sub scanning direction. The upstream-side and downstream-side heads each include a plurality of nozzles arrayed in the main scanning direction. Adjacent ones of the upstream-side and downstream-side heads are fitted to have overlapping portions in which a plurality of nozzles arranged in respective end portions of the heads overlap as seen from the sub scanning direction. During regular printing in which printing is performed based on image data, after the upstream-side head prints a line, when the first offset time passes, the control unit makes the downstream-side head print the same line in the sub scanning direction. The control unit makes only either the nozzles in the overlapping portion of the upstream-side head or the nozzles in the overlapping portion of the downstream-side head eject ink. During adjustment printing in which an adjustment chart for adjustment of the printing positions of the upstream-side and downstream-side heads in the sub scanning direction is printed, the control unit makes the upstream-side head print as the adjustment chart a first line, which is a straight line along the main scanning direction. The control unit makes the upstream-side head print a plurality of first lines at equal intervals. The control unit makes the nozzles in the overlapping portion of the upstream-side head print the first line. The control unit makes the downstream-side head print as the adjustment chart a second line, which is a straight line along the main scanning direction and which is paired with the first line. The control unit makes the nozzles in the overlapping portion of the downstream-side head print the second line. For each combination of the first and second lines, the control unit displaces the position in the sub scanning direction of the second line corresponding to the first line.

Further features and advantages of the present disclosure will become apparent from the description of embodiments given below.

DETAILED DESCRIPTION

The present disclosure relates to the printing of an adjustment chart that allows easier determination of the amount and the direction of deviation in printing position between heads in the sub-scanning direction. Hereinafter, with reference to FIGS. 1 to 14, an embodiment and a modified example of the present disclosure will be described. As an example of an inkjet recording apparatus, a printer 100 will be taken in the following description. All the features, in terms of structure, arrangement, and the like, described in connection with the embodiment are merely examples for the sake of description, and are in no way meant to limit the scope of the disclosure.

Printer 100

Figure 1:
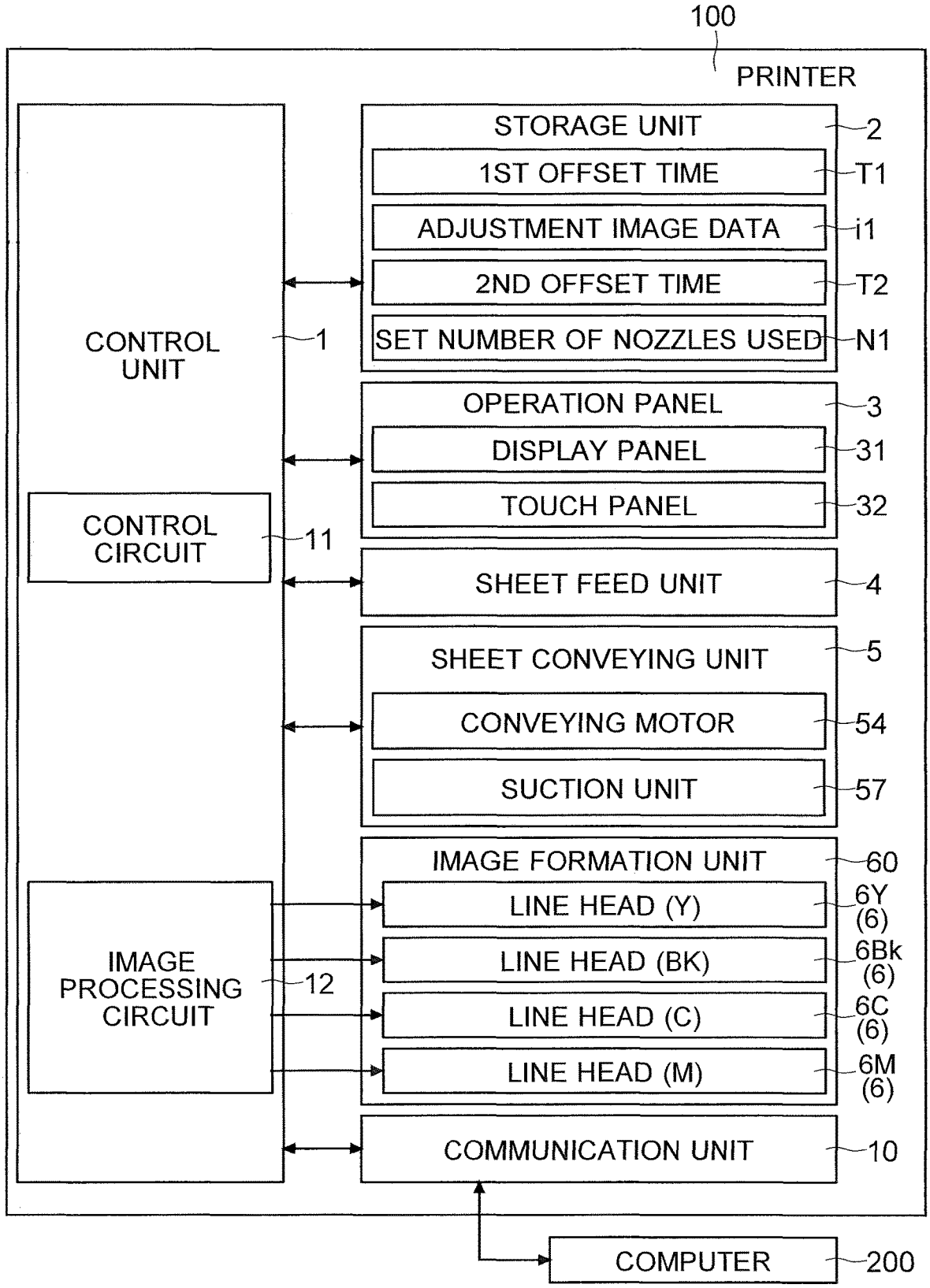
FIG. 1 is a diagram showing one example of a printer according to an embodiment.
Figure 2:
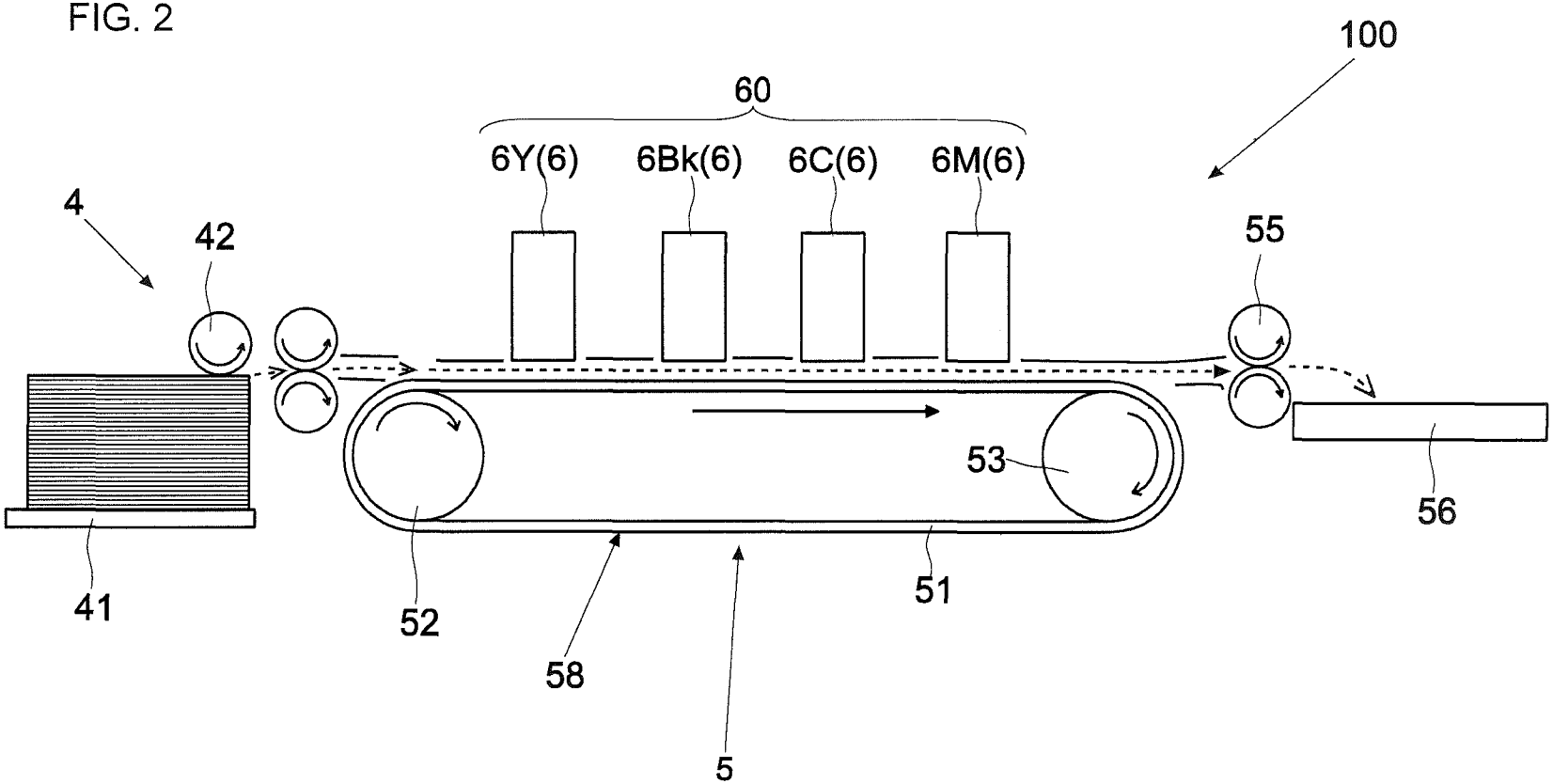
FIG. 2 is a diagram showing the one example of the printer according to the embodiment.

With reference to FIGS. 1 and 2, the configuration of a printer 100 according to an embodiment will be described. The printer 100 includes a control unit 1, a storage unit 2, an operation panel 3, a sheet feed unit 4, a sheet conveying unit 5, an image forming unit 60, and a communication unit 10. The control unit 1 controls printing operation. The control unit 1 includes a control circuit 11 and an image processing circuit 12. The control circuit 11 is, for example, a CPU. The control circuit 11 performs calculation and processing based on control programs and control data stored in the storage unit 2. The storage unit 2 includes a non-volatile storage device, such as a ROM, a HDD, and a flash ROM, and a volatile storage device, such as a RAM. The image processing circuit 12 performs image processing on image data to be used for printing, and thereby generates print image data i2.

The operation panel 3 accepts operation for setting and input. The operation panel 3 includes a display panel 31 and a touch panel 32. The display panel 31 displays setting screens and information. The display panel 31 displays operation images such as keys, buttons, and tabs. The touch panel 32 senses touch operations on the display panel 31. Based on the output of the touch panel 32, the control unit 1 recognizes operation images that are operated. The control unit 1 recognizes setting operations made by a user.

The sheet feed unit 4 includes a sheet feed tray 41 and a sheet feed roller 42. A stack of sheets is set on the sheet feed tray 41. The sheet feed roller 42 is provided in a downstream-side end part of the sheet feed tray 41 in the sheet conveying direction. The sheet feed roller 42 is rotated by a sheet feed motor (unillustrated). When printing is performed, the control unit 1 rotates the sheet feed motor. Thus, sheets are fed out from the sheet feed tray 41 one sheet after another, sequentially starting with the topmost sheet.

The sheet conveying unit 5 conveys a sheet. The sheet conveying unit 5 includes a conveying belt 51, a driving roller 52, a following roller 53, a conveying motor 54, a discharge roller pair 55, a discharge tray 56, and a suction unit 57. The sheet conveying unit 5 conveys the sheet fed out from the sheet feed unit 4. The sheet conveying unit 5 discharges the printed sheet out of the apparatus (onto the discharge tray 56).

On the downstream side (in FIG. 2, the right side) of the sheet feed unit 4 in the sheet conveying direction, a belt unit 58 is arranged. The belt unit 58 includes the conveying belt 51, the driving roller 52, and the following roller 53. The rotation axes of those rollers are parallel to each other. The conveying belt 51 is wound around the driving roller 52 and the following roller 53. During printing, the control unit 1 rotates the conveying motor 54. The conveying motor 54 rotates the driving roller 52. Thus, the conveying belt 51 moves around. The sheet on the conveying belt 51 is conveyed toward the downstream side in the sheet conveying direction (the sub scanning direction).

The sheet conveying unit 5 includes the discharge roller pair 55. The discharge roller pair 55 is provided on the downstream side of the conveying belt 51 in the sheet conveying direction. The discharge roller pair 55 is rotated by a discharge motor (unillustrated). During printing, the control unit 1 rotates the discharge motor. A sheet is discharged from the discharge roller pair 55 onto the discharge tray 56. The sheet conveying unit 5 also includes the suction unit 57. The suction unit 57 sucks a sheet onto the conveying belt 51. During printing, the control unit 1 makes the suction unit 57 operate.

The image forming unit 60 ejects ink onto the conveyed sheet, and thereby performs printing. The control unit 1 controls the ejection of ink. The image forming unit 60 includes a plurality of line heads 6. The control unit 1 makes those line heads 6 eject ink toward the sheet conveyed by the sheet conveying unit 5. The printer 100 is provided with four line heads 6 (6Y, 6Bk, 6C, and 6M). From the upstream side in the sheet conveying direction, a line head 6Y, a line head 6Bk, a line head 6C, and a line head 6M are arranged in this order. The line head 6Y ejects yellow ink. The line head 6Bk ejects black ink. The line head 6C ejects cyan ink. The line head 6M ejects magenta ink. These line heads 6 are stationary. Over the conveying belt 51, the line heads 6 are disposed. A predetermined gap is provided between the line heads 6 and the conveying belt 51.

The line heads 6 each include a plurality of nozzles 61. The openings of those nozzles 61 face the conveying belt 51. Ink is ejected from the nozzles 61. Ink lands on the conveyed sheet. Thereby, an image is formed. In the printer 100, the nozzles 61 are arrayed in the main scanning direction (the direction orthogonal to the sheet conveying direction, that is, the direction perpendicular to the plane of FIG. 2). The interval between the nozzles 61 in the main scanning direction determines the pixel-to-pixel pitch. For example, line heads 6 of 600 dpi give a pitch of about 42 μm. The sheet conveying unit 5 (belt unit 58) conveys a sheet by one pixel per period of ink ejection from the nozzles 61. The conveying motor 54 is, for example, a stepping motor. The control unit 1 feeds a pulse signal to the conveying motor 54. A sheet moves by one line (one pixel) per step (per pulse).

For each line head 6, there is provided an ink tank (unillustrated) that feeds it with ink; specifically, there are provided an ink tank that stores yellow ink, an ink tank that stores black ink, an ink tank that stores cyan ink, and an ink tank that stores magenta ink. These ink tanks feed ink to the corresponding line heads 6.

The control unit 1 is connected to each line head 6. The control unit 1 (image processing circuit 12) feeds the line heads 6 with the print image data i2. The control unit 1 transmits the print image data i2, line by line, to the line heads 6. The print image data i2 is data that specifies whether or not to eject ink from each nozzle 61. Based on the received image data, the line heads 6 print an image by using ink.

The communication unit 10 includes a communication memory and communication hardware (a connector, a socket, and a circuit). The communication memory stores communication software and transmission/reception data. The communication unit 10 communicates with a computer 200. The computer 200 is, for example, a PC or a server. The control unit 1 receives print data from the computer 200. The print data includes print settings and print contents. For example, the print data includes data written in a page description language. The control unit 1 (image processing circuit 12) analyzes the received (fed-in) print data. Based on the received print data, the control unit 1 generates image data (raster data) to be used in image formation in the image forming unit 60. Based on the generated image data, the control unit 1 generates the print image data i2. Based on the generated print image data i2, the control unit 1 makes the image forming unit 60 perform printing.

Line Heads 6

Next, with reference to FIGS. 3 and 4, an example of the line heads 6 according to the embodiment will be described. The line heads 6 all have a similar structure. The following description, referring to FIGS. 3 and 4, takes the yellow line head 6Y as an example. A similar description applies to the black, cyan, and magenta line heads 6.

Figure 3:
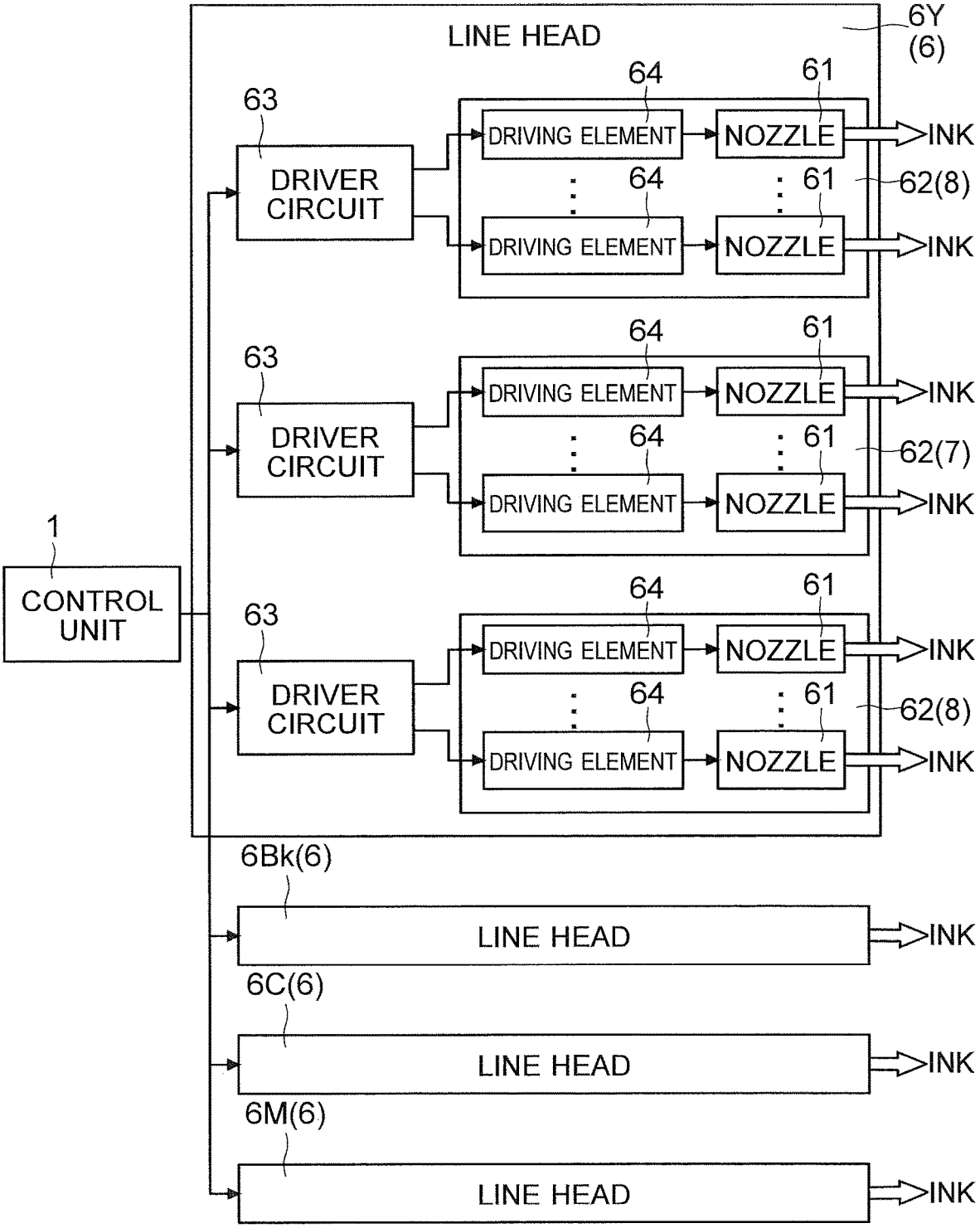
FIG. 3 is a diagram showing one example of a line head according to the embodiment.
Figure 4:
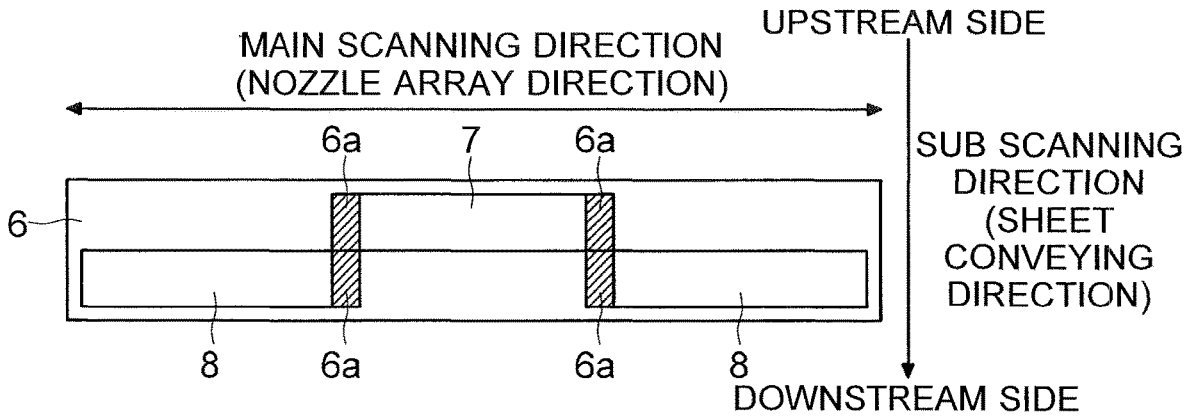
FIG. 4 is a diagram showing the one example of the line head according to the embodiment.

As shown in FIG. 3, one line head 6 includes a plurality of recording heads 62. FIG. 3 shows an example where three recording heads 62 are arranged in the main scanning direction. In the following description, with respect to the sub scanning direction (sheet conveying direction), a head on the upstream side in the sub scanning direction is referred to as an upstream-side head 7, and a head on the downstream side in the sub scanning direction is referred to as a downstream-side head 8. An upstream-side head 7 is located on the upstream side of a downstream-side head 8 in the sub scanning direction. A downstream-side head 8 is located on the downstream side of an upstream-side head 7 in the sub scanning direction. FIG. 3 shows an example where there are provided one upstream-side head 7 and two downstream-side heads 8. One line head 6 can include two or more upstream-side heads 7. One line head 6 can include three or more downstream-side heads 8.

The upstream-side and downstream-side heads 7 and 8 each include a plurality of nozzles 61. The nozzles 61 are arrayed in the main scanning direction (the direction perpendicular to the sheet conveying direction). The upstream-side and downstream-side heads 7 and 8 are fitted to have overlapping portions 6*a*. The overlapping portions 6*a* each include a plurality of nozzles 61 arranged in end parts of the heads involved, and are where the upstream-side and downstream-side heads 7 and 8 overlap as seen in the sub scanning direction. In FIG. 4, the overlapping portions 6*a* are indicated by hatching. Each overlapping portion 6*a* includes, for example, about 10 to 20 nozzles. Thus, as seen from the sub scanning direction, the upstream-side head 7 is fitted such that the nozzles 61 in end parts of it neighboring the downstream-side heads 8 overlap end parts of the downstream-side heads 8; as seen from the sub scanning direction, the downstream-side heads 8 are fitted such that the nozzles 61 in end parts of them neighboring the upstream-side head 7 overlap the end parts of the upstream-side head 7. In the end parts of the upstream-side head 7 neighboring the downstream-side heads 8 and in the end parts of the downstream-side heads 8 neighboring the upstream-side head 7 (that is, in the overlapping portions 6*a*), the nozzles are in two rows.

As shown in FIG. 3, the line heads 6 each include driver circuits 63. For example, for one recording head 62, one driver circuit 63 is provided. For one recording head 62, a plurality of driver circuits 63 may be provided. The driver circuits 63 control the operation of the line heads 6. The image processing circuit 12 transmits to the driver circuits 63 the print image data i2. Based on the received print image data i2, the driver circuits 63 control whether or not to eject ink from each nozzle 61.

The line heads 6 (recording heads 62) have the nozzles 61 formed at even intervals in the main scanning direction. For example, the nozzles 61 are formed by etching or by perforating a metal sheet. For one nozzle 61, one driving element 64 is provided. The driving elements 64 are piezoelectric elements. The driver circuits 63 turn on and off application of a voltage to the driving elements 64 individually. The driver circuits 63 apply a pulse voltage to the driving elements 64 corresponding to the nozzles 61 from which to eject ink. The driving elements 64 deform when a voltage is applied to them. A pressure resulting from the deformation is applied to a flow passage that feeds the nozzles 61 with ink. The pressure to the flow passage causes the nozzles 61 to eject ink. On the other hand, the driver circuits 63 do not apply a voltage to the driving elements 64 corresponding to the pixels at which not to eject ink. The driver circuits 63 virtually control the ejection of ink. For the sake of convenience, FIG. 3 shows part of the interior of only one line head 6Y. The line heads 6 for different colors have a similar structure.

The control unit 1 (image processing circuit 12) generates the print image data i2 for each line head 6 (for each color). The control unit 1 transmits the generated print image data i2 to the line heads 6. The print image data i2 is data (binary data) that specifies whether or not to eject ink for each pixel and line. The control unit 1 (image processing circuit 12) transmits the image data, line by line in the main scanning direction, to the driver circuits 63.

The control unit 1 may feed the driver circuits 63 with a clock signal. Based on the clock signal, the period (frequency) of ink ejection is determined. In a printing job, the period at which the driver circuits 63 apply a voltage to the driving elements 64 is constant. The control unit 1 makes the sheet conveying unit 5 convey a sheet at such a speed that a sheet moves by one dot (one line) per period of ink ejection. The control unit 1 makes the sheet conveying unit 5 convey a sheet at a predetermined sheet conveying speed. From top to bottom of a page, line-by-line print processing is repeated in the sub scanning direction, so that one page is printed.

Regular Printing

Figure 5:
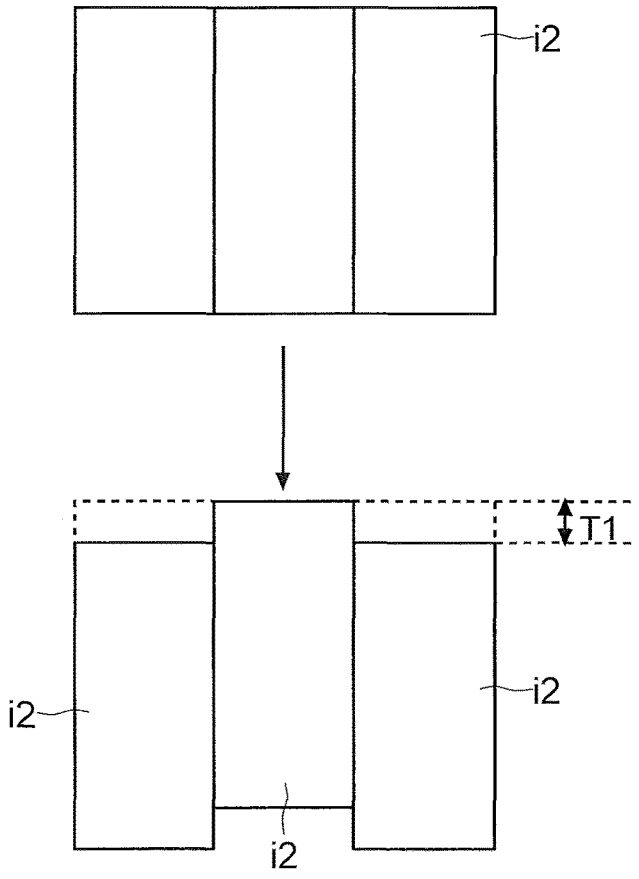
FIG. 5 is a diagram illustrating regular printing on the printer according to the embodiment.

Next, with reference to FIG. 5, one example of regular printing on the printer 100 according to the embodiment will be described. The line heads 6 include a plurality of recording heads 62. An upstream-side head 7 and a downstream-side head 8 are located at different positions in the sub scanning direction. The printing positions of the upstream-side and downstream-side heads 7 and 8 in the sub scanning direction need to be aligned. Thus, the control unit 1 divides the print image data i2 for one page. The control unit 1 divides image data into a part to be printed by the upstream-side head 7 and a part to be printed by the downstream-side head 8. In a case where one line head 6 includes three recording heads 62, the control unit 1 divides the print image data i2 into three parts along the sub scanning direction.

The control unit 1 makes only either the nozzles 61 in the overlapping portion 6*a* of the upstream-side head 7 or the nozzles 61 in the overlapping portion 6*a* of the downstream-side head 8 eject ink. When the control unit 1 makes the nozzles 61 in the overlapping portion 6*a* of the upstream-side head 7 perform printing, it does not make the nozzles 61 in the overlapping portion 6*a* of the downstream-side head 8 perform printing. The control unit 1 makes the pixels in the print image data i2 corresponding to the nozzles 61 in the overlapping portion 6*a* of the downstream-side head 8 white (a value specifying no ink ejection). When the control unit 1 makes the nozzles 61 in the overlapping portion 6*a* of the downstream-side head 8 perform printing, it does not make the nozzles 61 in the overlapping portion 6*a* of the upstream-side head 7 perform printing. The control unit 1 makes the pixels in the print image data i2 corresponding to the nozzles 61 in the overlapping portion 6*a* of the upstream-side head 7 white (a value specifying no ink ejection).

Considering the difference between the positions of the upstream-side and downstream-side heads 7 and 8 in the sub scanning direction, after the upstream-side head prints a given line, when the first offset time T1 passes, the control unit 1 makes the downstream-side head 8 print the same line. The control unit 1 (image processing circuit 12) transmits the print image data i2, line by line, to the driver circuits 63. The storage unit 2 stores the first offset time T1 on a non-volatile basis. Based on the first offset time T1 stored in the storage unit 2, the control unit 1 displaces the timing of printing of the same line by the upstream-side head 7 from that by the downstream-side head 8. In a case where one line head 6 includes a plurality of downstream-side heads 8, the first offset time T1 is set for each of the downstream-side heads 8.

After the print image data i2 for a given line is transmitted to the upstream-side head 7, when the first offset time T1 passes, the control unit 1 transmits the print image data i2 for the given line (the same line) to the downstream-side head 8. That is, the control unit 1 displaces the timing of transmission of the print image data i2 for the same line by the first offset time T1. As a result, the time point of ink ejection for printing the same line is displaced by the first offset time T1. The initial value of the first offset time T1 is determined beforehand. The first offset time T1 is determined based on the time calculated by dividing the specification-stated (designed) distance from the nozzles 61 of the upstream-side head 7 to the nozzles 61 of the downstream-side head 8 in the sub scanning direction by the specification-stated (designed) sheet conveying speed. The time required to convey a sheet by the specification-stated distance between the nozzles 61 in the sub scanning direction is set to be the initial value of the first offset time T1.

Printing of Adjustment Chart 9

Figure 6:
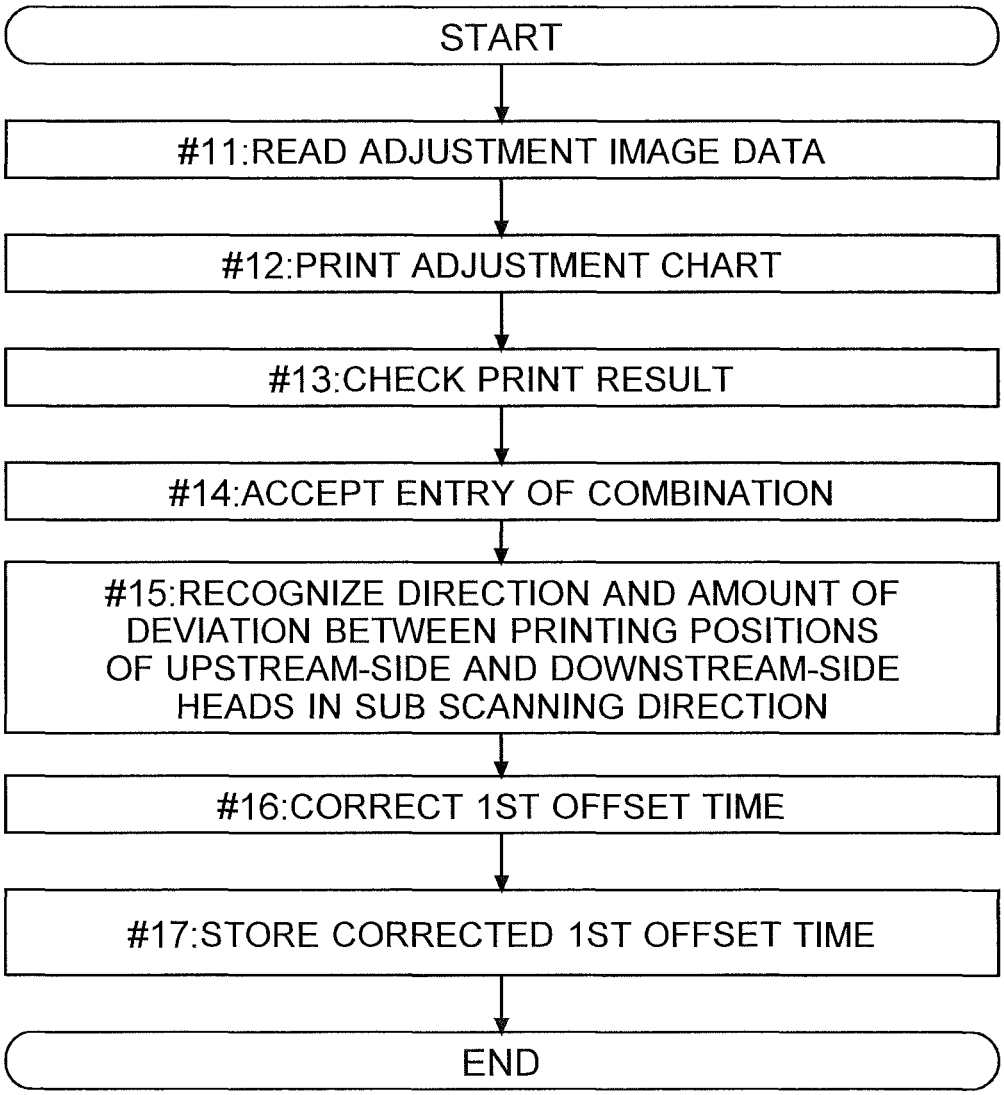
FIG. 6 is a diagram showing one example of printing of an adjustment chart on the printer according to the embodiment.

Next, with reference to FIGS. 6 to 8, one example of the printing of an adjustment chart 9 on the printer 100 according to the embodiment will be described. On the printer 100, an adjustment chart 9 can be printed. The adjustment chart 9 is a print result for aligning the printing positions of the upstream-side and downstream-side heads 7 and 8 in sub scanning direction. The adjustment chart 9 can be printed as a kind of image quality adjustment for the printer 100. For example, the adjustment chart 9 is printed during the set-up or maintenance of the printer 100. The operation panel 3 accepts an instruction requesting printing of the adjustment chart 9. A procedure, shown FIG. 6, starts when the operation panel 3 accepts an instruction requesting printing of the adjustment chart 9.

The control unit 1 reads adjustment image data i1 (step #11). The adjustment image data i1 is image data for the printing of an adjustment chart 9. The storage unit 2 stores the adjustment image data i1 on a non-volatile basis (see FIG. 1). The control unit 1 controls such that the adjustment chart 9 is printed based on the adjustment image data i1 (step #12). Specifically, the control unit 1 makes the sheet feed unit 4 feed a sheet. The control unit 1 makes the sheet conveying unit 5 convey the sheet. The control unit 1 then makes the image forming unit 60 print the adjustment chart 9 based on the adjustment image data i1.

Figure 7:
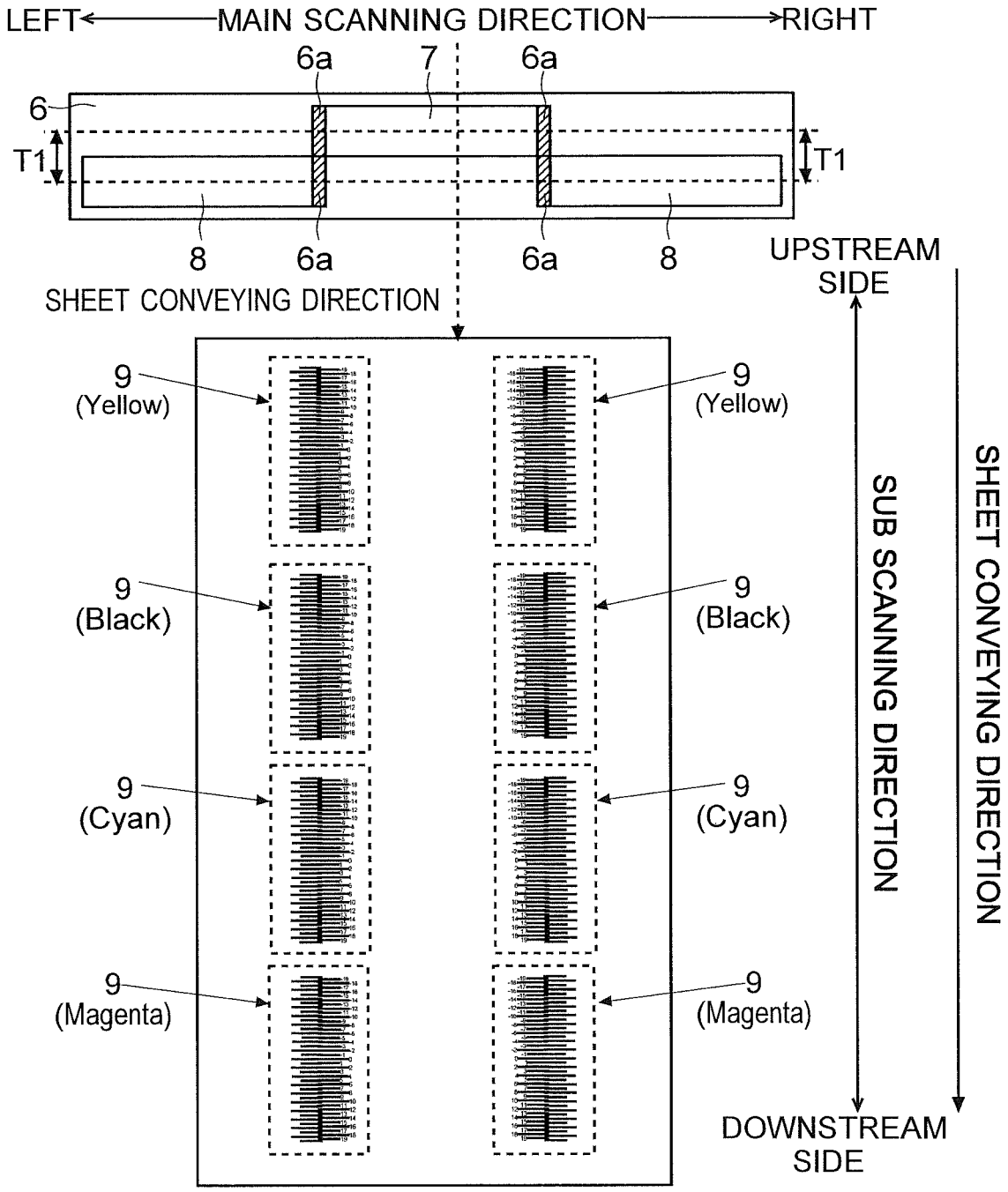
FIG. 7 is a diagram showing one example of a print result of the adjustment chart according to the embodiment.

FIG. 7 is a diagram showing one example of a print result of the adjustment chart 9. The control unit 1 controls such that adjustment charts 9 for different colors are printed on a sheet. A yellow, a black, a cyan, and a magenta adjustment chart 9 are printed in this order from the upstream side in the sub scanning direction (sheet conveying direction). The order in which the different colors are printed is the same as the order in which the line heads 6 for the different colors are arranged.

The numbers of adjustment charts 9 printed are equal to the numbers of downstream-side heads 8 included in the respective line heads 6. This is for aligning the printing positions of the upstream-side and downstream-side heads 7 and 8 in the sub scanning direction. Each line head 6 includes two downstream-side heads 8. Accordingly, two adjustment charts 9 per color are printed. As for a left adjustment chart 9 in the adjustment chart 9 in FIG. 7, the control unit 1 makes the upstream-side head 7 as well as the downstream-side head 8 in the left side in the main scanning direction print it; as for a right adjustment chart 9, the control unit 1 makes the upstream-side head 7 as well as the downstream-side head 8 in the right side in the main scanning direction print it.

As for a first line L1 in the adjustment chart 9, the control unit 1 makes the upstream-side head 7 print it. The first line L1 is a straight line along the main scanning direction. The control unit 1 makes the upstream-side head 7 print a plurality of first lines L1. The control unit 1 makes the upstream-side head 7 print first lines L1 at equal intervals (reference intervals). The intervals are determined beforehand. Also in the adjustment image data i1, the intervals between first lines L1 are reference intervals. The control unit 1 makes the nozzles 61 in the overlapping portion 6*a* of the upstream-side head 7 print the first line L1. The control unit 1 makes a plurality of nozzles 61 of the upstream-side head 7 which are contiguous with the overlapping portion 6*a* print the first line L1. That is, the control unit 1 makes those nozzles 61 which are located within a given range including the nozzles 61 in a one-end part of the upstream-side head 7 print the first line L1.

As for a second line L2 in the adjustment chart 9, the control unit 1 makes the downstream-side head 8 print it. The second line L2 is a straight line along the main scanning direction. The second line L2 is a line paired with the first line L1. The second line L2 is a line for the measurement (determination) of the direction and the amount of deviation in printing position in the sub scanning direction. The control unit 1 makes the downstream-side head 8 print a plurality of second lines L2. The control unit 1 makes the nozzles 61 in the overlapping portion 6*a* of the downstream-side head 8 print the second line L2. That is, the control unit 1 makes those nozzles 61 which are located within a given range from the nozzles 61 in an end part of the downstream-side head 8 closer to the upstream-side head 7 print the second line L2. For each combination of the first and second lines L1 and L2, the control unit 1 displaces the position in the sub scanning direction of (the timing of ink ejection for) the second line L2 corresponding to the first line L1.

Figure 8:
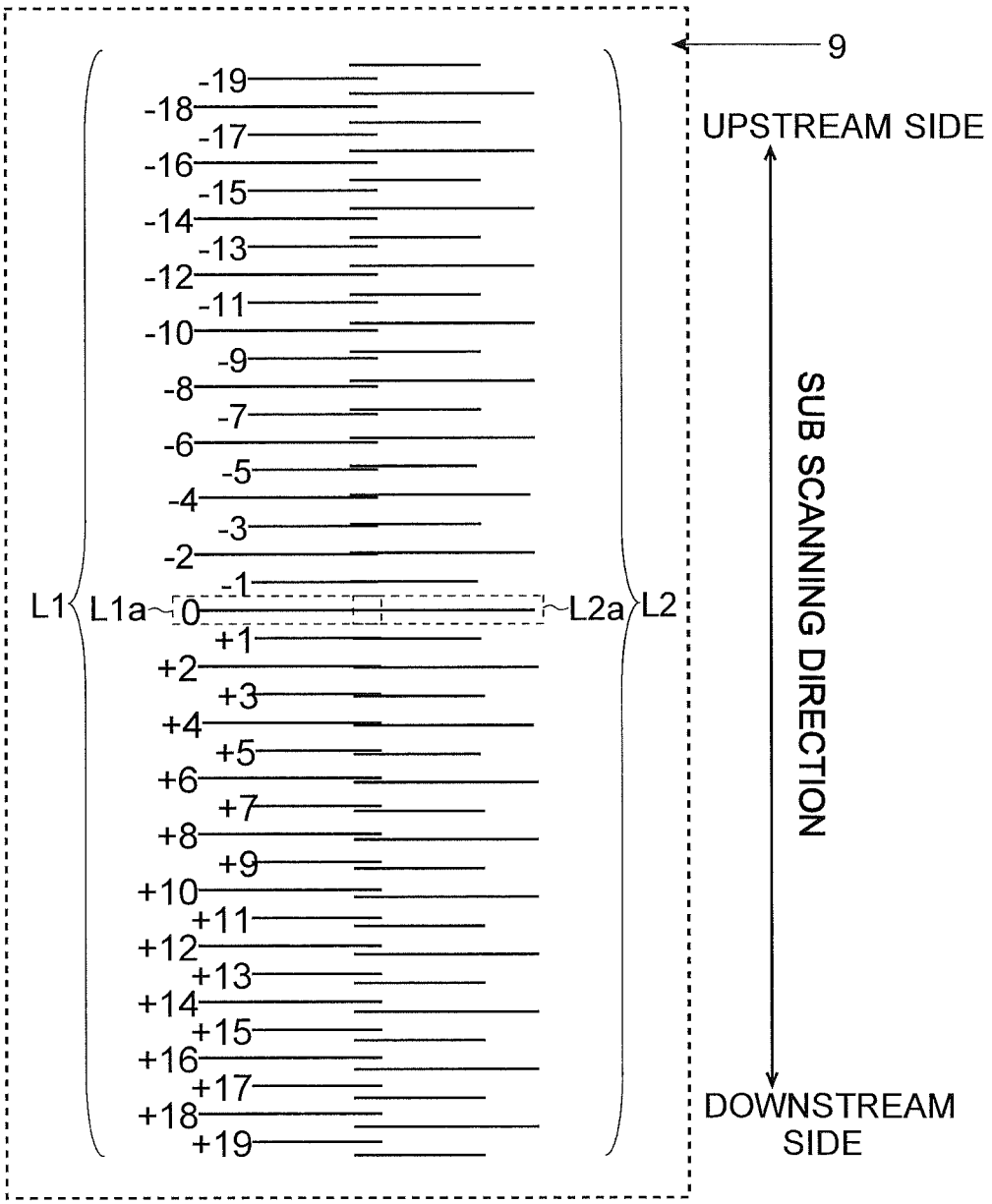
FIG. 8 is a diagram showing one example of an enlarged view of the adjustment chart according to the embodiment.

FIG. 8 is an enlarged view of an adjustment chart 9. The adjustment chart 9 in FIG. 8 is one example of a right adjustment chart 9 in FIG. 7. For black, cyan, and magenta, similar adjustment charts 9 are printed. FIG. 8 shows an example of an adjustment chart 9 printed using the nozzles 61 in, with respect to the main scanning direction, a one-end portion (right-end portion) of the upstream-side head 7 for a given color and the nozzles 61 in an other-end portion (left-end portion) of the downstream-side head 8 for the same color.

It should be noted that, in a left adjustment chart 9 in FIG. 7, the lines in the left side are second lines L2 and the lines in the right side are first lines L1. That is, in a case where the downstream-side head 8 is located on one side (right side) of the upstream-side head 7 in the main scanning direction, the control unit 1 controls such that first lines L1 are printed in the other side (left side) and second lines L2 are printed in one side (right side). By contrast, in a case where the downstream-side head 8 is located on the other side (left side) of the upstream-side head 7 in the main scanning direction, the control unit 1 controls such that first lines L1 are printed in one side (right side) and second lines L2 are printed in the other side (left side).

In the adjustment chart 9 in FIG. 8, the lines in the left side are first lines L1. First lines L1 are marked with values indicating the direction and amount of deviation. In the adjustment chart 9 in FIG. 8, the lines in the right side are second lines L2. Second lines L2 are not marked with numerical figures. The control unit 1 makes the upstream-side head 7 print first lines L1 at reference (equal) intervals. For example, the first line L1 is a straight line that extends in the main scanning direction and that has a width of one dot in the sub scanning direction. Of a plurality of first lines L1, the one at the middle is a first reference line L1*a*. The control unit 1 makes the upstream-side head 7 print the first reference line L1*a* marked with the numerical figure "0".

After ink for the first reference line L1*a* is ejected, when the first offset time T1 passes, the control unit 1 makes the downstream-side head 8 eject ink for a second reference line L2*a*. The second line L2 is a straight line that extends in the main scanning direction and that has a width of one dot in the sub scanning direction. The second reference line L2*a* is a second line L2 that is paired with the first reference line L1*a*. In a case where the upstream-side and downstream-side heads 7 and 8 are fitted with no deviation, when printing is performed using the initial value of the first offset time T1, the first and second reference lines L1*a* and L2*a* overlap in the sub scanning direction. The first and second lines L1 and L2 form a single straight line.

The control unit 1 makes the downstream-side head 8 print the second line L2 at equal intervals. The interval between the second lines L2 is (reference interval+1 line). The control unit 1 makes the downstream-side head 8 print m lines on the downstream side of the second reference line L2*a* in the sub scanning direction. The control unit 1 makes the downstream-side head 8 print n lines on the upstream side of the second reference line L2*a* in the sub scanning direction (In FIG. 8, m=19, n=19).

After ink ejection for the most downstream first line L1, the control unit 1 makes the downstream-side head 8 eject ink for the most downstream second line L2. This time interval is a time calculated by subtracting from the first offset time T1 time required to convey a sheet by m dots (m lines). Afterwards, the control unit 1 makes the downstream-side head 8 eject ink at (reference interval+1 line) intervals. The control unit 1 makes the downstream-side head 8 print the second lines L2.

After the adjustment charts 9 are printed, a check of the print results by a user or a person in charge of maintenance is performed (step #13). The operation panel 3 accepts entry of the combination of the first and second lines L1 and L2 with the smallest deviation (step #14). Based on the numerical figure indicating the entered combination, the control unit 1 recognizes the direction and the amount of deviation between the printing positions of the upstream-side and downstream-side heads 7 and 8 in the sub scanning direction (step #15).

The control unit 1 makes the nozzles 61 in the overlapping portions 6*a* of the upstream-side and downstream-side heads 7 and 8 print the adjustment chart 9. In a combination of the first and second lines L1 and L2 of which the printing positions in the sub scanning direction coincide, the first and second lines L1 and L2 form a single straight line. Moreover, the landing positions of ink from the nozzles 61 in the respective overlapping portions 6*a* overlap. In a combination of the first and second lines L1 and L2 of which the printing positions in the sub scanning direction coincide, the part printed by the nozzles 61 in the overlapping portions 6*a* is darker. Thus, a combination of the first and second lines L1 and L2 of which the printing positions in the sub scanning direction coincide is easy to recognize.

On the other hand, in a combination with non-coincident printing positions in the sub scanning direction, the first and second lines L1 and L2 do not form a single straight line. Moreover, the landing positions of ink from the nozzles 61 in the respective overlapping portions 6*a* deviate in the sub scanning direction. In a combination of with non-coincident printing positions in the sub scanning direction, the part printed by the nozzles 61 in the overlapping portions 6*a* is thicker in the sub scanning direction, or alternates in the main scanning direction. Thus, also a combination of the first and second lines L1 and L2 of which the printing positions in the sub scanning direction do not coincide is easy to recognize.

When the adjustment charts 9 are printed, the control unit 1 makes the display panel 31 display an adjustment entry screen. The adjustment entry screen is a screen for entering the combination of the first and second lines L1 and L2 with the smallest deviation for each adjustment chart (for each color, for each downstream-side head 8). When, as shown in FIG. 7, eight adjustment charts 9 are printed, the control unit 1 controls such that eight entry fields are displayed on the adjustment entry screen. When an entry field is operated, the control unit 1 controls such that a software keyboard for entry is displayed. The checking person enters, using the software keyboard, a numerical figure indicating the combination of the first and second lines L1 and L2 with the smallest deviation.

For example, when, in the adjustment chart 9 for black in one side, the first and second lines L1 and L2 marked with the sign "+2" overlap with the smallest deviation, the person checking the adjustment chart 9 enters "+2" in the entry field for black in one side. Thus, delaying the printing position of the downstream-side head 8 by two lines will result in the printing positions of the upstream-side and downstream-side heads 7 and 8 for black coinciding in the sub scanning direction. The control unit 1 recognizes that, assuming that printing is performed using the current first offset time T1, the printing position of the downstream-side head 8 in the sub scanning direction is two lines (dots) earlier with respect to the printing position of the upstream-side head 7.

When, in the adjustment chart 9 for black in the other side, the first and second lines L1 and L2 marked with the sign "−3" overlap with the smallest deviation, the person checking the adjustment chart 9 enters "−3" in the entry field for black in the other side. Ink is ejected three lines later than at the proper position. In this case, advancing the printing position of the downstream-side head 8 by three lines will result in the printing positions of the upstream-side and downstream-side heads 7 and 8 for black coinciding in the sub scanning direction. The control unit 1 recognizes that, assuming that printing is performed using the current first offset time T1, the printing position of the downstream-side head 8 in the sub scanning direction is three lines (dots) later with respect to the printing position of the upstream-side head 7.

As described above, based on entry on the operation panel 3, the control unit 1 can recognize the direction and the amount of deviation between the printing positions of the upstream-side and downstream-side heads 7 and 8. The control unit 1 can recognize the direction and the amount of deviation between the printing positions of the upstream-side and downstream-side heads 7 and 8 in the respective line heads 6 for different colors.

Based on the recognized direction and amount of deviation, the control unit 1 corrects the first offset time T1 (step #16). The control unit 1 performs correction so as to eliminate the deviation in the sub scanning direction between the positions of the same line printed by the upstream-side and downstream-side heads 7 and 8. The control unit 1 then makes the storage unit 2 store the corrected first offset time T1 on a non-volatile basis (step #17).

For example, when the printing position of the downstream-side head 8 is a lines (a dots) earlier, the control unit 1 performs correction in which it adds a time to the uncorrected first offset time T1. The control unit 1 adds to the uncorrected first offset time T1 the time required to move a sheet (the conveying belt 51) a lines. In other words, the control unit 1 adds to the uncorrected first offset time T1 the period corresponding to a steps of the conveying motor 54.

When the printing position of the downstream-side head 8 is b lines (b dots) later, the control unit 1 performs correction in which it lessens the uncorrected first offset time T1. The control unit 1 performs correction in which it subtracts from the uncorrected first offset time T1 the time required to move a sheet (the conveying belt 51) b lines. In other words, the control unit 1 subtracts from the uncorrected first offset time T1 the period corresponding to b steps of the conveying motor 54.

In the subsequent regular printing, the control unit 1 performs printing using the corrected first offset time T1. Specifically, for a given line, after the print image data i2 for the line is transmitted to the upstream-side head 7, when the corrected first offset time T1 passes, the control unit 1 transmits the print image data i2 for the line to the downstream-side head 8. The control unit 1 displaces the timing of transmission of (the timing of ink ejection for) the print image data i2 for the same line by the corrected first offset time T1.

Adjusting the Number of Nozzles 61 Used in the Overlapping Portion 6*a*

Figure 9:
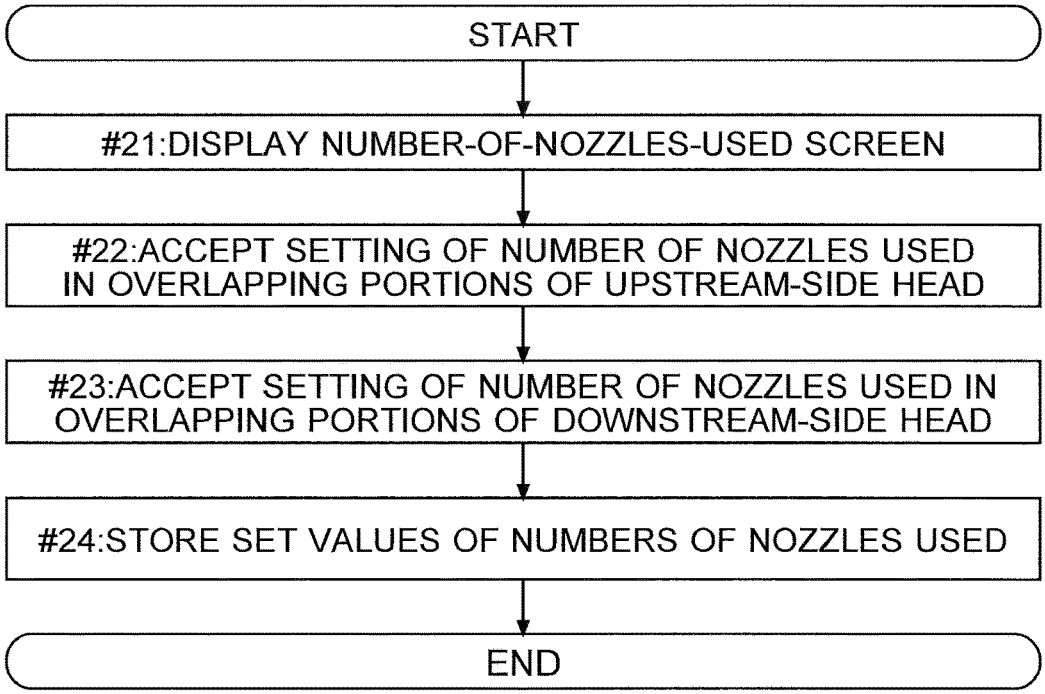
FIG. 9 is a diagram showing one example of setting of the number of nozzles used in an overlapping portion in the printer according to the embodiment.

Next, with reference to FIG. 9, one example of the setting of the number of the nozzles 61 used in the overlapping portion 6*a* on the printer 100 according to the embodiment will be described.

In the printing of the adjustment chart 9, the control unit 1 makes the nozzles 61 in the respective overlapping portions 6*a* of the upstream-side and downstream-side heads 7 and 8 eject ink. When an overlapping portion 6*a* is used, compared to when no overlapping portion 6*a* is used, twice the ordinary amount of ink is ejected onto the part printed in the overlapping portion 6*a*. Ink in the part printed in the overlapping portion 6*a* may bleed. A combination of the first and second lines L1 and L2 of which the printing positions coincide can be difficult to see.

Figure 10:
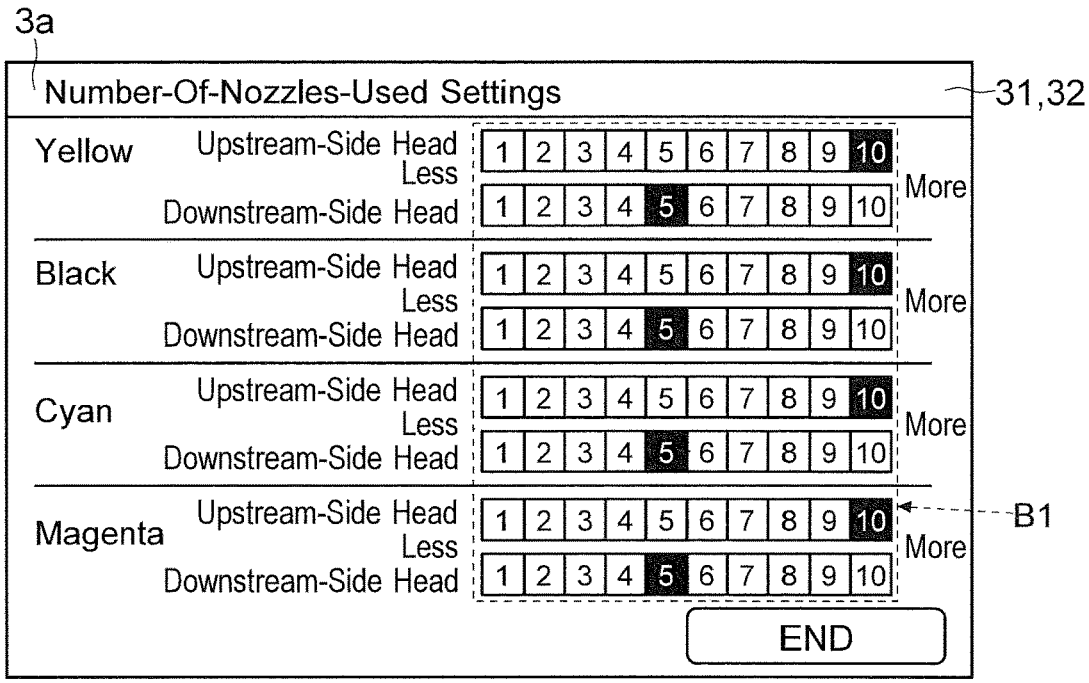
FIG. 10 is a diagram showing one example of a number-of-nozzles-used setting screen according to the embodiment.

This can be overcome by allowing setting of the number of nozzles 61 in the overlapping portion 6*a* used in the printing of the adjustment chart 9. A procedure, shown FIG. 9, starts when the operation panel 3 accepts the start of setting of the number of nozzles 61 used in the overlapping portion. The control unit 1 makes the display panel 31 display a number-of-nozzles-used setting screen 3*a* (step #21). FIG. 10 shows one example of the number-of-nozzles-used setting screen 3*a*. The control unit controls such that a plurality of number-of-nozzles-used setting buttons B1 for setting the number of nozzles used are displayed in the number-of-nozzles-used setting screen 3*a*. FIG. 10 shows a case where the respective overlapping portions 6*a* of the heads 7 each include 10 nozzles 61. The control unit 1 controls such that the number-of-nozzles-used setting buttons B1 are displayed for each of the upstream-side and downstream-side heads 7 and 8 for different colors. The control unit 1 controls such that as many number-of-nozzles-used setting buttons B1 are displayed as the number of nozzles 61 included in the overlapping portion 6*a*. FIG. 10 shows an example where 80 (4 colors×2 (upstream and downstream sides)×10 (the number of nozzles)) number-of-nozzles-used setting buttons B1 are displayed.

A user can set the number of nozzles 61 used in the overlapping portion 6*a* by operating (touching) a number-of-nozzles-used setting button B1. The control unit 1 operates such that the number-of-nozzles-used setting button B1 indicating the currently set number of nozzles is displayed in reversed black and white. The operation panel 3 accepts setting of the number of nozzles 61 used in the overlapping portion 6*a* of the upstream-side head 7 (step #22). Likewise, the operation panel 3 accepts setting of the number of nozzles 61 used in the overlapping portion 6*a* of the downstream-side head 8 (step #23). The control unit 1 then makes the storage unit 2 store the thus set set values (set number-of-nozzles-used values N1) on a non-volatile basis (step #24, see FIG. 1). The default (initial) values of the numbers of nozzles 61 used are the maximum values for both upstream-side and downstream-side heads 7 and 8 for each color.

The control unit 1 makes the set number of nozzles 61 among the nozzles 61 in the overlapping portion 6*a* of the upstream-side head 7 print the adjustment chart 9. Specifically, the control unit 1 selects, from the nozzles 61 in the overlapping portion 6*a*, as many nozzles 61 as the set number starting with the nozzle 61 at an end of (far from) the neighboring downstream-side head 8 in the main scanning direction. The control unit 1 makes the selected nozzles 61 print the adjustment chart 9. When the number of nozzles is reduced, the line printed by the nozzles 61 in the overlapping portion 6*a* of the upstream-side head 7 shortens. The length of the overlapping part of the lines printed by the upstream-side and downstream-side heads 7 and 8 diminishes.

The control unit 1 makes the set number of nozzles 61 among the nozzles 61 in the overlapping portion 6*a* of the downstream-side head 8 print the adjustment chart 9. Specifically, the control unit 1 selects, from the nozzles 61 in the overlapping portion 6*a*, as many nozzles 61 as the set number starting with the nozzle 61 at an end of (far from) the neighboring upstream-side head 7 in the main scanning direction. The control unit 1 makes the selected nozzles 61 print the adjustment chart 9. When the number of nozzles is reduced, the line printed by the nozzles 61 in the overlapping portion 6*a* of the downstream-side head 8 shortens. The length of the overlapping part of the lines printed by the upstream-side and downstream-side heads 7 and 8 diminishes.

Modified Example

Next, with reference to FIGS. 11 to 14, a modified example of the printing of an adjustment chart 9 on the printer 100 according to the embodiment will be described. Also according to the modified example, the printer 100 can print an adjustment chart 9 for aligning the printing positions of an upstream-side head 7 and a downstream-side head 8 in the sub scanning direction. In the modified example, for the yellow line head 6Y, a reference line head is determined.

The reference line head is a line head for other than yellow. As the reference line head, any one of the black, cyan, and magenta line heads can be selected. The following description deals with an example where the reference line head is the black line head 6Bk. The black line head 6Bk is located next to (one position on the downstream side of) the yellow line head 6Y. When a sheet enters the discharge roller pair 55, the sheet conveying speed can vary. Using as the reference line head a line head 6 close to the yellow line head 6Y helps reduce the effect of a factor that causes variation of the sheet conveying speed. This makes it possible to accurately recognize the deviation between the printing positions of the upstream-side and downstream-side heads 7 and 8.

A yellow-only image can be difficult to see. On an adjustment chart 9 printed in yellow only on a white sheet, it can be difficult to find a combination of lines with coincident printing positions. To cope with that, in the modified example, for yellow, an adjustment chart 9 in which lines by the reference line head (black) and lines by the yellow line head 6Y are combined is printed. Based on the adjustment chart 9 that includes black lines as well as yellow lines, the direction and the amount of deviation between the positions of the upstream-side and downstream-side heads 7 and 8 are recognized. For black, cyan, and magenta, adjustment charts similar to those in the embodiment described previously are used.

Figure 11:
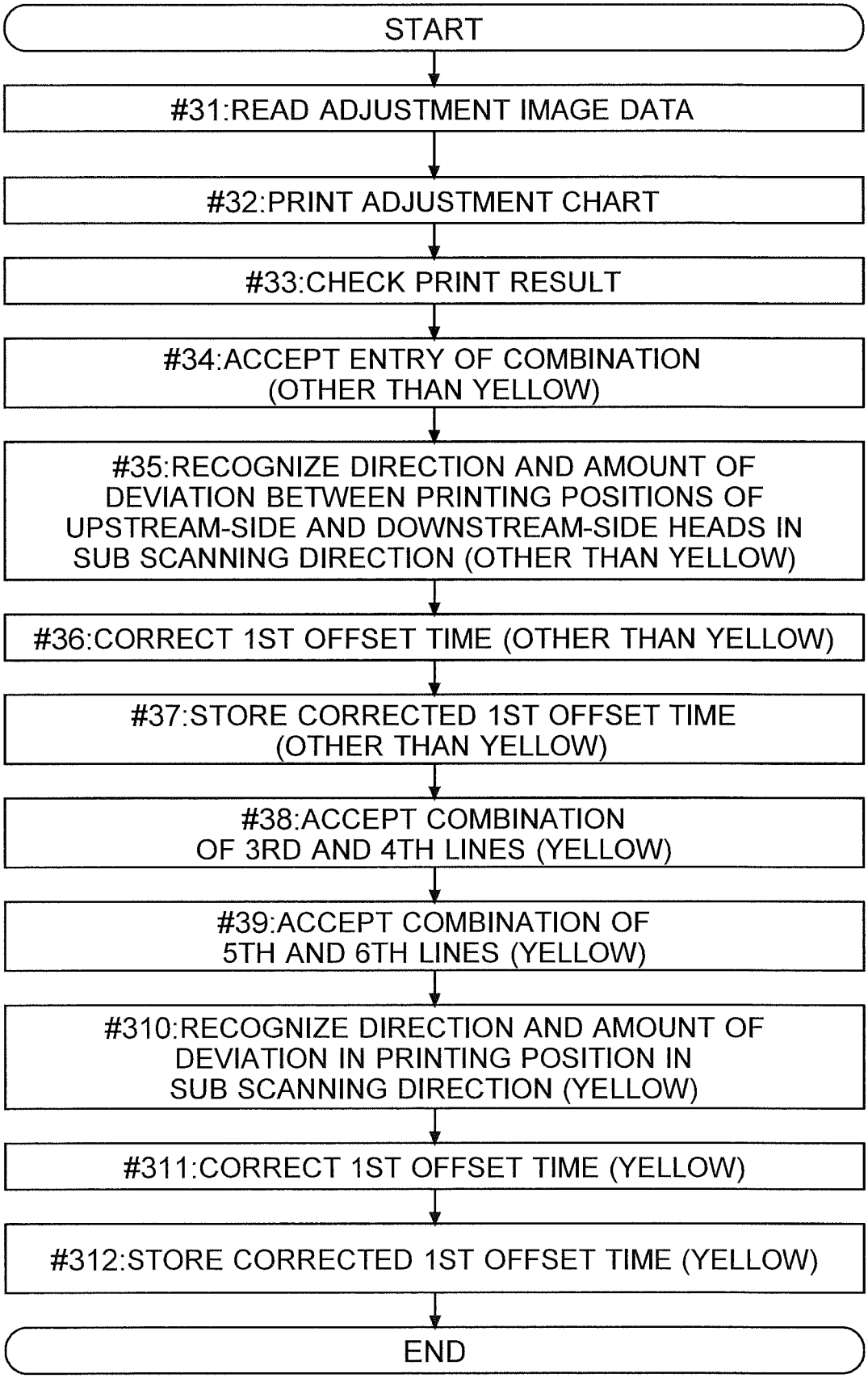
FIG. 11 is a diagram showing one example of printing of an adjustment chart on a printer according to a modified example.

A procedure, shown FIG. 11, starts when the operation panel 3 accepts an instruction requesting printing. The control unit 1 reads adjustment image data i1 (step #31). The adjustment image data i1 is an image data for the printing of an adjustment chart 9. The storage unit 2 stores the adjustment image data i1 on a non-volatile basis (see FIG. 1). The adjustment image data i1 in the modified example is so prepared that an adjustment chart 9 for yellow is printed in black and yellow. The control unit 1 controls such that the adjustment chart 9 is printed (step #32). Specifically, the control unit 1 makes the sheet feed unit 4 feed a sheet. The control unit 1 makes the sheet conveying unit 5 convey the sheet. The control unit 1 then makes the image forming unit 60 print the adjustment chart 9 based on the adjustment image data i1.

Figure 12:
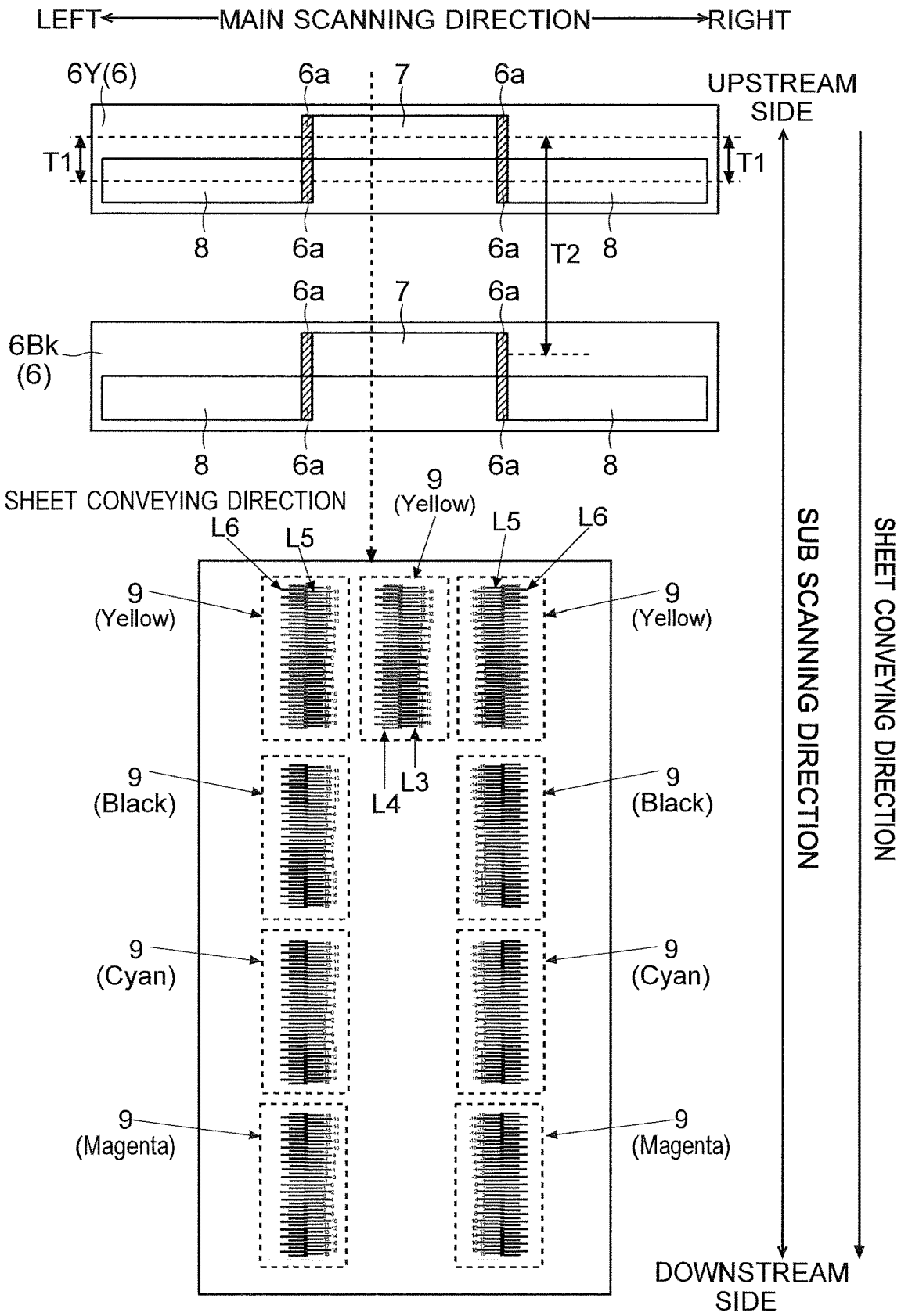
FIG. 12 is a diagram showing one example of a print result of the adjustment chart according to the modified example.

FIG. 12 shows one example of a print result of the adjustment chart 9 according to the modified example. The control unit 1 controls such that adjustment charts 9 for different colors are printed on a sheet. A yellow, a black, a cyan, and a magenta adjustment chart 9 are printed in this order from the upstream side in the sub scanning direction (sheet conveying direction). The order in which the different colors are printed is the same as the order in which the line heads 6 for the different colors are arranged. Here, however, the control unit 1 controls such that the adjustment chart 9 for the yellow line head 6Y is printed by use of, as well as the yellow line head 6Y, the black line head 8Bk. For black, cyan, and magenta, the numbers of adjustment charts 9 printed are equal to the numbers of downstream-side heads 8 included in the respective line heads 6. This is the same as in the embodiment described previously. On the other hand, for yellow, the number of adjustment charts 9 printed is the total of the number of downstream-side and upstream-side heads 8 included in the line head 6.

In the modified example, the control unit 1 makes the upstream-side head 7 in the reference line head (that is, the reference upstream-side head) print a third line L3. Thus, the third line L3 is black. The control unit 1 makes, of the reference upstream-side head, those nozzles 61 which do not print a fifth line L5 (which will be described later), print the third line L3. The control unit 1 makes the upstream-side head 7 in the yellow line head 6Y (that is, the yellow upstream-side head 7) print a fourth line L4. The fourth line L4 is yellow. The control unit 1 makes the upstream-side heads 7 print adjustment charts 9 including the third and fourth lines L3 and L4. The control unit 1 makes the reference upstream-side head and the yellow upstream-side head 7 print such that the third and fourth lines L3 and L4 overlap partly in the main scanning direction.

In FIG. 12, the adjustment chart 9 at the middle in the topmost row is the adjustment chart 9 that includes the third and fourth lines L3 and L4. As for the third line L3 in the adjustment chart 9, the control unit 1 makes the upstream-side head 7 in the reference line head (that is, the reference upstream-side head) print it. The third line L3 is a straight line along the main scanning direction. The control unit 1 makes the reference upstream-side head print a plurality of third lines L3. The control unit 1 makes the reference upstream-side head print third lines L3 at equal intervals (reference intervals). The intervals between third lines L3 is determined beforehand. Also in the adjustment image data i1, the intervals between third lines L3 are reference intervals.

As for the fourth line L4 in the adjustment chart 9, the control unit 1 makes the yellow upstream-side head 7 print it. The fourth line L4 is a straight line along the main scanning direction. The fourth line L4 is a line that is paired with the third line L3. The fourth line L4 is a line for the measurement (determination) of the direction and the amount of deviation in printing position in the sub scanning direction. The control unit 1 makes the yellow upstream-side head 7 print a plurality of fourth lines L4. For each combination of the third and fourth lines L3 and L4, the control unit 1 displaces the position in the sub scanning direction of (the timing of ink ejection for) the fourth line L4 corresponding to the third line L3.

Figure 13:
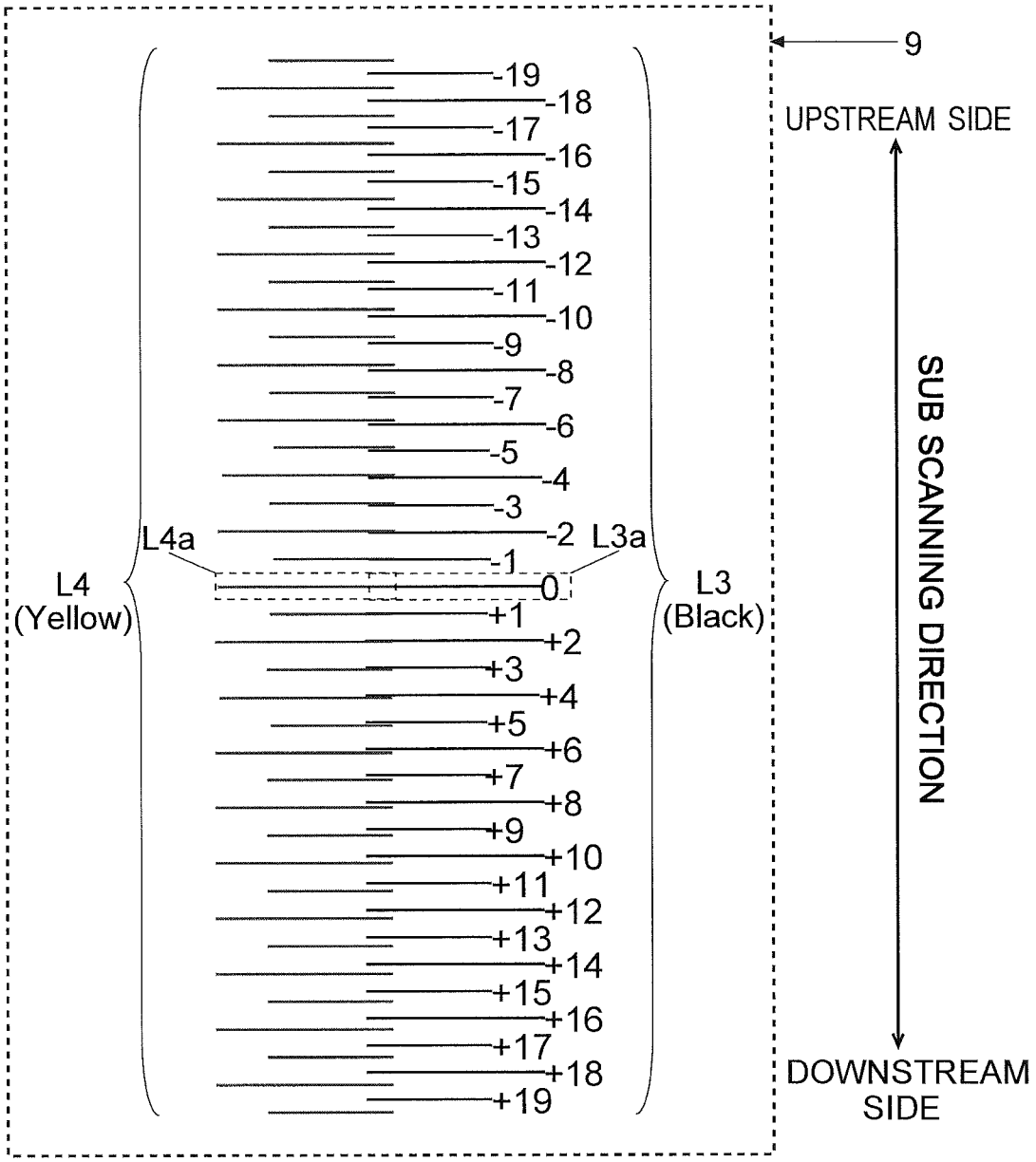
FIG. 13 is a diagram showing one example of an enlarged view of an adjustment chart for yellow according to the modified example.

FIG. 13 is an enlarged view of an adjustment chart 9 including the third and fourth lines L3 and L4. As seen in the adjustment chart 9 in FIG. 13, third lines L3 are marked with numerical figures which are values indicating the direction and amount of deviation. In the adjustment chart 9 in FIG. 13, the lines in the left side are fourth lines L4 (yellow). Fourth lines L4 are not marked with numerical figures.

The control unit 1 makes the reference upstream-side head print third lines L3 at reference intervals. For example, the third line L3 is a straight line that extends in the main scanning direction and that has a width of one dot in the sub scanning direction. Of a plurality of third lines L3, the one at the middle is a third reference line L3*a*. The control unit 1 makes the reference upstream-side head print the third reference line L3*a* marked with the numerical figure "0".

After a fourth reference line L4*a* is printed, when a second offset time T2 passes, the control unit 1 makes the black upstream-side head 7 print the third reference line L3*a*. The second offset time T2 is determined beforehand. For example, the second offset time T2 is set to be the time required to convey a sheet across the number of lines corresponding to the distance in the sub scanning direction between the nozzles 61 of the yellow upstream-side head 7 and the nozzles 61 of the reference upstream-side head. The storage unit 2 stores the second offset time T2 on a non-volatile basis (see FIG. 1). Based on the second offset time T2 stored in the storage unit 2, the control unit 1 displaces the timing of printing by the yellow upstream-side head 7 from that by the reference upstream-side head. In a case where one line head 6 includes a plurality of upstream-side heads 7, the second offset time T2 may be set for each of the upstream-side heads 7.

After the print image data i2 for a given line is transmitted to the yellow upstream-side head 7, when a time passes, the control unit 1 transmits the print image data i2 for the same line to the reference upstream-side head. That is, for the same line, the control unit 1 displaces the timing of transmission of the print image data i2 to the yellow upstream-side head 7 from that to the reference upstream-side head. For example, the control unit 1 displaces the timing by the second offset time T2. As a result, for the reference line, the time point of ink ejection by the yellow upstream-side head 7 is displaced by the second offset time T2 from that by the reference upstream-side head.

The fourth line L4 is a straight line that extends in the main scanning direction and that has a width of one dot in the sub scanning direction. The fourth reference line L4*a* is a fourth line L4 that is paired with the third reference line L3*a*. After the print image data i2 for the fourth reference line L4*a* is transmitted to the yellow upstream-side head 7, when the second offset time T2 passes, the control unit 1 transmits the print image data i2 for the third reference line L3*a* to the reference upstream-side head.

The control unit 1 makes the yellow upstream-side head 7 print the fourth line L4 at equal intervals. The interval between the fourth lines L4 is (reference interval+1 line). The control unit 1 makes the yellow upstream-side head 7 print m lines on the downstream side of the fourth reference line L4*a* in the sub scanning direction. The control unit 1 makes the yellow upstream-side head 7 print n lines on the upstream side of the fourth reference line L4*a* in the sub scanning direction (In FIG. 13, m=19, n=19).

After ink ejection for the most downstream fourth line L4, the control unit 1 makes the reference upstream-side head eject ink for the most downstream third line L3. This time interval is a time calculated by subtracting from the second offset time T2 time required to convey a sheet by m dots (m lines). After ink ejection at the most downstream fourth line L4, the control unit 1 makes the yellow upstream-side head 7 eject ink at (reference interval+1 line) intervals. The control unit 1 makes the downstream-side head 8 print the fourth lines L4

As for the fifth line L5 in the yellow adjustment chart 9, the control unit 1 makes the reference upstream-side head print it. In the yellow adjustment chart 9 in FIG. 12, the left and right adjustment charts 9 include the fifth line L5. The fifth line L5 is a straight line along the main scanning direction. The control unit 1 makes the reference upstream-side head print a plurality of fifth lines L5. The control unit 1 makes the reference upstream-side head print fifth lines L5 at equal intervals (reference intervals). Also in the adjustment image data i1, the intervals between fifth lines L5 are reference intervals. The positions of the third and fifth lines L3 and L5 can be the same. The control unit 1 makes the nozzles 61 in the overlapping portion 6*a* of the reference upstream-side head print the fifth line L5. The control unit 1 makes those nozzles 61 which are located within a given range from the nozzles 61 in an end part of the reference upstream-side head print the fifth line L5.

As for a sixth line L6 in the adjustment chart 9, the control unit 1 makes the yellow downstream-side head 8 print it. The sixth line L6 is a straight line along the main scanning direction. The sixth line L6 is a line paired with the fifth line L5. The sixth line L6 is a line for the measurement (determination) of the direction and the amount of deviation in printing position for yellow in the sub scanning direction. The control unit 1 makes the yellow downstream-side head 8 print a plurality of sixth lines L6. The control unit 1 makes the nozzles 61 in the overlapping portion 6*a* of the yellow downstream-side head 8 print the sixth line L6. That is, the control unit 1 makes the nozzles 61 located in a given range from the nozzles 61 in an end part of the yellow downstream-side head 8 closer to the yellow upstream-side head 7 print the sixth line L6. For each combination of the fifth and sixth lines L5 and L6, the control unit 1 displaces the position in the sub scanning direction of (the timing of ink ejection for) the sixth line L6 corresponding to the fifth line L5.

Figure 14:
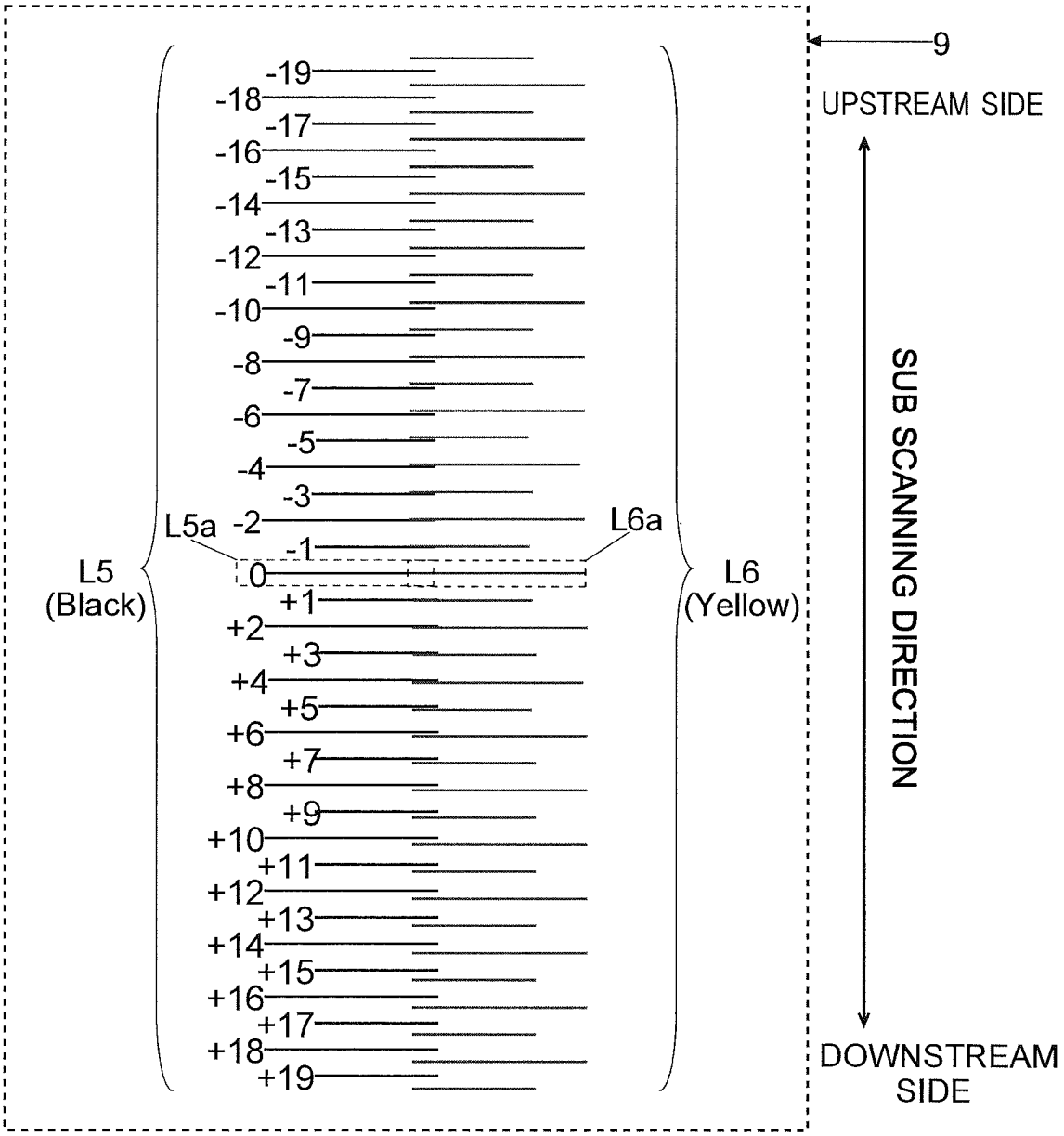
FIG. 14 is a diagram showing one example of an enlarged view of the adjustment chart for yellow according to the modified example.

FIG. 14 is an enlarged view of an adjustment chart 9. The adjustment chart 9 in FIG. 14 is one example of the adjustment chart 9 at the right end in the yellow adjustment chart 9 in FIG. 12. That is, FIG. 14 shows an example of an adjustment chart 9 printed using the nozzles 61 in a one-end part (right-end part) of the reference upstream-side head in the main scanning direction and the nozzles 61 in an other-end part (left-end part) of the yellow downstream-side head 8.

In the adjustment chart 9 in FIG. 14, the lines in the left side are fifth lines L5. Numerical figures are values indicating the direction and amount of deviation. In the adjustment chart 9 in FIG. 14, the lines in the right side are sixth lines L6. Sixth lines L6 are not marked with numerical figures. It should be noted that, in the left-end, yellow, adjustment chart 9 in FIG. 12, the lines in the left side are sixth lines L6 and the lines in the right side are fifth lines L5. In a case where the yellow downstream-side head 8 is located on one side (right side) of the yellow upstream-side head 7 (reference upstream-side head) in the main scanning direction, the control unit 1 controls such that fifth lines L5 are printed in the other side (left side) and sixth lines L6 are printed in one side (right side). By contrast, in a case where the yellow downstream-side head 8 is located on the other side (left side) of the reference upstream-side head (reference upstream-side head) in the main scanning direction, the control unit 1 controls such that fifth lines L5 are printed in one side (right side) and sixth lines L6 are printed in the other side (left side).

The control unit 1 makes the reference upstream-side head print fifth lines L5 at reference intervals. Of a plurality of fifth lines L5, the one at the middle is a fifth reference line L5*a*. The control unit 1 makes the reference upstream-side head print the fifth reference line L5*a* marked with the numerical figure "0". After a sixth reference line L6*a* is printed, when a time calculated by subtracting from the second offset time T2 the first offset time T1 for yellow passes, the control unit 1 makes the reference upstream-side head print the fifth reference line L5*a*. For example, the fifth and sixth lines L5 and L6 are straight lines that extend in the main scanning direction and that have a width of one dot in the sub scanning direction. The sixth reference line L6*a* is a line paired with the fifth reference line L5*a*. In a case where the reference upstream-side head and the yellow downstream-side head 8 are fitted with no deviation, when printing is performed using the initial values of the first and second offset times T1 and T2, the fifth and sixth reference lines L5*a* and L6*a* overlap in the sub scanning direction. The fifth and sixth reference lines L5*a* and L6*a* form a single straight line.

The control unit 1 makes the yellow downstream-side head 8 print the sixth lines L6 at equal intervals. The interval between the sixth lines L6 is (reference interval+1 line). The control unit 1 makes the yellow downstream-side head 8 print m lines on the downstream side of the sixth reference line L6*a* in the sub scanning direction. The control unit 1 makes the yellow downstream-side head 8 *n* lines on the upstream side of the sixth reference line L6*a* in the sub scanning direction. (In FIG. 14, m=19, n=19).

After ink ejection for the most downstream sixth line L6, the control unit 1 makes the reference upstream-side head eject ink for the most downstream fifth lines L5. This time interval is a time calculated by subtracting from the second offset time T2 time A and time B. The time A is the first offset time T1 of yellow. The time B is required to convey a sheet by m dots (m lines). After ink ejection at the most downstream sixth lines L6, the control unit 1 makes the yellow downstream-side head 8 eject ink at (reference interval+1 line) intervals. The control unit 1 makes the downstream-side head 8 print the sixth lines L6.

After the adjustment charts 9 are printed, a check of the print results by a user or a person in charge of maintenance is performed (step #33). For the line heads 6 for other than yellow, the operation panel 3 accepts entry of a combination of the first and second lines L1 and L2 with the smallest deviation (step #34). For the line heads 6 for other than yellow, based on the numerical figure indicating the entered combination, the control unit 1 recognizes the direction and the amount of deviation between the printing positions of the upstream-side and downstream-side heads 7 and 8 in the sub scanning direction (step #35). For the line heads 6 for other than yellow, based on the recognized direction and amount of deviation, the control unit 1 corrects the first offset time T1 so as to eliminate the deviation in the sub scanning direction between the positions of the same line printed by the upstream-side and downstream-side heads 7 and 8 (step #36). Then, the control unit 1 makes the storage unit 2 store the corrected first offset time T1 for other than yellow on a non-volatile basis (step #37). Steps #33 through #37 are similar to, and thus can be described in a similar manner as, steps #13 through #17; accordingly, no detailed description of steps #33 through #37 will be given.

For the yellow line head 6Y, the operation panel 3 accepts entry of the combination of the third and fourth lines L3 and L4 with the smallest deviation (step #38). Moreover, the operation panel 3 accepts the combination of the fifth and sixth lines L5 and L6 with the smallest deviation (step #39). The control unit 1 makes the reference upstream-side head and the yellow upstream-side head 7 print an adjustment chart 9 (the third and fourth lines L3 and L4). The control unit 1 controls such that the third and fourth lines L3 and L4 overlap partly. In a combination of the third and fourth lines L3 and L4 of which the printing position in the sub scanning direction coincide, the third and fourth lines L3 and L4 form a single straight line. Moreover, in a combination of the third and fourth lines L3 and L4 of which the printing positions in the sub scanning direction coincide, the overlapping parts have a darker color. Thus, a combination of the third and fourth lines L3 and L4 of which the printing positions in the sub scanning direction coincide is easy to recognize.

The control unit 1 makes the nozzles 61 in the overlapping portions 6*a* of the reference upstream-side head and the yellow downstream-side head 8 print an adjustment chart 9 (the fifth and sixth lines L5 and L6). In a combination of the fifth and sixth lines L5 and L6 of which the printing positions in the sub scanning direction coincide, the fifth and sixth lines L5 and L6 form a single straight line. Moreover, the landing positions of ink from the nozzles 61 in the respective overlapping portions 6*a* overlap. In a combination of the fifth and sixth lines L5 and L6 of which the printing positions in the sub scanning direction coincide, the part printed by the nozzles 61 in the overlapping portions 6*a* is darker. A combination of the third and fourth lines L3 and L4 of which the printing positions in the sub scanning direction coincide is easy to recognize.

In a combination of the fifth and sixth lines L5 and L6 of which the printing positions in the sub scanning direction do not coincide, the fifth and sixth lines L5 and L6 do not form a single straight line. In a combination of the fifth and sixth lines L5 and L6 of which the printing positions in the sub scanning direction do not coincide, the part printed by the nozzles 61 in the overlapping portions 6*a* is thicker in the sub scanning direction, or alternates in the main scanning direction. Thus, also a combination of the fifth and sixth lines L5 and L6 of which the printing positions in the sub scanning direction do not coincide is easy to recognize.

When the adjustment charts 9 are printed, the control unit 1 makes the display panel 31 display an adjustment entry screen. When, as shown in FIG. 12, nine adjustment charts 9 are printed, the control unit 1 controls such that nine entry fields are displayed on the adjustment entry screen. When an entry field is operated, the control unit 1 controls such that a software keyboard for entry is displayed. For other than yellow, the checking person enters, using the software keyboard, a numerical figure indicating the combination of the first and second lines L1 and L2 with the smallest deviation. On the other hand, for yellow, the checking person enters, using the software keyboard, a numerical figure indicating the combination of the third and fourth lines L3 and L4 and the combination of the fifth and sixth lines L5 and L6 each with the smallest deviation.

For example, when, in an adjustment chart 9 for yellow, the third and fourth lines L3 and L4 marked with the sign "+2" overlap with the smallest deviation, the person checking the adjustment chart 9 enters "+2" in the entry field for the adjustment chart 9 showing the third and fourth lines L3 and L4. Ink is ejected two lines earlier than at the proper position. Accordingly, the control unit 1 recognizes that a delay of two lines in addition to the current second offset time T2 will result in the third and fourth lines L3 and L4 coinciding. That is, the control unit 1 recognizes that the current timing of ejection is two lines (two dots) earlier with respect to the ideal timing with which the printing positions of the black upstream-side head 7 and the yellow upstream-side head 7 coincide in the sub scanning direction.

For another example, when, in a given adjustment chart 9 for yellow, the fifth and sixth lines L5 and L6 marked with the sign "−3" overlap with the smallest deviation, the person checking the adjustment chart 9 enters "−3" in the entry field corresponding to the adjustment chart 9 showing the fifth and sixth lines L5 and L6. Ink is ejected three lines later than at the proper position. The control unit 1 recognizes that, assuming that printing is performed based on the current second offset time T2 combined with the current first offset time T1 for yellow, advancing the timing of ejection three lines in the sub scanning direction will result in the fifth and sixth lines L5 and L6 coinciding. That is, the control unit 1 recognizes that the current timing of ejection is three lines (three dots) later with respect to the ideal timing with which the printing positions of the black upstream-side head 7 and the yellow downstream-side head 8 coincide in the sub scanning direction.

As described above, based on entry on the operation panel 3, the control unit 1 can recognize the direction and the amount of deviation between the printing positions of the reference upstream-side head and the yellow upstream-side head 7. Moreover, the control unit 1 can recognize the direction and the amount of deviation between the printing positions of the reference upstream-side head and the yellow downstream-side head 8. Based on the directions and amounts of deviation thus recognized, the control unit 1 recognizes the direction and the amount of deviation between the positions of the yellow upstream-side head 7 and the yellow downstream-side head 8 (step #310). Then, the control unit 1 corrects, in the yellow line head 6Y, the first offset time T1 so as to eliminate the deviation in printing position in the sub scanning direction (step #311). The control unit 1 then makes the storage unit 2 store the corrected first offset time T1 for yellow on a non-volatile basis (step #312).

For example, consider a case where the printing position of the yellow upstream-side head 7 is two lines (two dots) earlier with respect to the printing position of the reference upstream-side head and the printing position of the yellow downstream-side head 8 is three lines (three dots) later in the downstream direction with respect to the printing position of the reference upstream-side head. In the sub scanning direction, the deviation between the printing positions of the yellow upstream-side head 7 and the yellow downstream-side head 8 is five lines (five dots) in total. The distance from the position at which the third and fourth lines L3 and L4 overlap with the smallest deviation to the position at which the fifth and sixth lines L5 and L6 overlap with the smallest deviation is the amount of deviation between the printing positions of the yellow upstream-side head 7 and the yellow downstream-side head 8.

The control unit 1 can recognize the direction of deviation based on the direction pointing from the position at which the third and fourth lines L3 and L4 overlap with the smallest deviation to the position at which the fifth and sixth lines L5 and L6 overlap with the smallest deviation. For example, assume that the third line L3 at which the third and fourth lines L3 and L4 overlap best has the sign "+2" and that the fifth line L5 at which the fifth and sixth lines L5 and L6 overlap best has the sign "−3". In this case, to adjust the printing position of the yellow downstream-side head 8 to the printing position of the yellow upstream-side head 7, the printing position of the yellow downstream-side head 8 can be moved five lines in the plus direction (in the delaying direction). This means that the yellow downstream-side head 8 is currently ejecting ink 5 lines earlier than at the position that coincides with the printing position of the yellow upstream-side head 7.

For example, when the printing position of the yellow downstream-side head 8 is c lines (c dots) earlier than the printing position of the yellow upstream-side head 7, the control unit 1 performs correction in which it adds a time to the first offset time T1. The control unit 1 adds to the uncorrected first offset time T1 the time required to move a sheet (the conveying belt 51) c lines. In other words, the control unit 1 adds to the uncorrected first offset time T1 the period corresponding to c steps of the conveying motor 54. In the above example, the control unit 1 adds to the uncorrected first offset time T1 the time required to move a sheet (conveying belt 51) five lines.

On the other hand, when the printing position of the yellow downstream-side head 8 is d lines (d dots) later than the printing position of the yellow upstream-side head 7 in the sub scanning direction, the control unit 1 performs correction in which it lessens the first offset time T1. The control unit 1 subtracts from the uncorrected first offset time T1 the time required to move a sheet (the conveying belt 51) d lines. That is, the control unit 1 subtracts from the uncorrected first offset time T1 the period corresponding to d steps of the conveying motor 54.

Also in the modified example, in the subsequent regular printing, the control unit 1 performs printing using the corrected first offset time T1. For a given line, after the print image data i2 for the line is transmitted to the upstream-side head 7, when the corrected first offset time T1 passes, the control unit 1 transmits the print image data i2 for the line to the downstream-side head 8. For the same line, the control unit 1 displaces the timing of transmission of (the timing of ink ejection for) the print image data i2 by the corrected first offset time T1.

As described above, according to the embodiment or the modified example, a printer 100 (inkjet recording apparatus) includes a sheet conveying unit 5, a storage unit 2, a line head 6, and a control unit 1. The sheet conveying unit 5 conveys a sheet. The storage unit 2 stores a first offset time T1. The line head 6 ejects ink onto the sheet conveyed by the sheet conveying unit, thereby to perform printing. The control unit 1 controls the ejection of ink from the line head 6. The line head 6 includes an upstream-side head 7 and a downstream-side head 8. The upstream-side head 7 is located on the upstream side of the downstream-side head 8 in the sub scanning direction. The upstream-side and downstream-side heads 7 and 8 each include a plurality of nozzles 61 arrayed in the main scanning direction. Adjacent ones of the upstream-side and downstream-side heads 7 and 8 are fitted to have overlapping portions 6*a* in which a plurality of nozzles 61 arranged in respective end portions of the heads overlap as seen from the sub scanning direction. During regular printing in which printing is performed based on image data, after the upstream-side head 7 prints a line, when the first offset time T1 passes, the control unit 1 makes the downstream-side head 8 print the same line in the sub scanning direction. The control unit 1 makes only either the nozzles 61 in the overlapping portion 6*a* of the upstream-side head 7 or the nozzles 61 in the overlapping portion 6*a* of the downstream-side head 8 eject ink. During adjustment printing in which an adjustment chart 9 for adjustment of the printing positions of the upstream-side and downstream-side heads 7 and 8 in the sub scanning direction is printed, the control unit 1 makes the upstream-side head 7 print as the adjustment chart 9 a first line L1, which is a straight line along the main scanning direction. The control unit 1 makes the upstream-side head 7 print a plurality of first lines L1 at equal intervals. The control unit 1 makes the nozzles 61 in the overlapping portion 6*a* of the upstream-side head 7 print the first line L1. The control unit 1 makes the downstream-side head 8 print as the adjustment chart 9 a second line L2, which is a straight line along the main scanning direction and which is paired with the first line L1. The control unit 1 makes the nozzles 61 in the overlapping portion 6*a* of the downstream-side head 8 print the second line L2. For each combination of the first and second lines L1 and L2, the control unit 1 displaces the position in the sub scanning direction of (the timing of ink ejection for) the second line L2 corresponding to the first line L1.

An adjustment chart 9 for checking for a deviation in printing position in the sub scanning direction can be printed. With the adjustment chart 9, the user can check the amount and the direction of deviation between the printing positions of the upstream-side and downstream-side heads 7 and 8 in the sub scanning direction. The nozzles 61 included in the respective overlapping portions 6*a* of the upstream-side and downstream-side heads 7 and 8 can be made to print the adjustment chart 9. In a combination, of all combinations, of the first and second lines L1 and L2 of which the printing positions in the sub scanning direction coincide, the first and second lines L1 and L2 printed by the nozzles 61 in the overlapping portions 6*a* overlap. In the overlapping parts, the first and second lines L1 and L2 form a single straight line and have a darker color. It is possible to print an adjustment chart 9 in which a combination with coincident positions in the sub scanning direction is easy to recognize. That is, it is possible to print an adjustment chart 9 that allows accurate recognition of the amount and the direction of deviation between the printing positions of the heads in the sub scanning direction.

Based on the combination, entered on an operation panel 3, of the first and second lines L1 and L2 with the smallest deviation, the control unit 1 recognizes the direction and the amount of deviation in the sub scanning direction. Based on the recognized direction and amount of deviation, the control unit 1 corrects the first offset time T1 such that the printing positions of the same line coincide in the sub scanning direction between the upstream-side and downstream-side heads 7 and 8. It is possible to accurately recognize the amount and the direction of deviation, and thus to accurately correct the first offset time T1 (ejection time lag) so as to eliminate the deviation.

The inkjet recording apparatus (printer 100) includes a plurality of line heads 6 that eject ink of different colors. During adjustment printing, the control unit 1 makes each of the line heads 6 print the adjustment chart 9. The control unit 1 adjusts the first offset time T1 for each of the line heads 6. It is possible to eliminate, for each line head 6, a deviation in printing position in the sub scanning direction. It is possible to make, for each line head 6, the printing positions of the upstream-side and downstream-side heads 7 and 8 coincide.

According to the modified example, an inkjet recording apparatus (printer 100) includes a plurality of line heads 6 that eject ink of different colors. One of the line heads 6 ejects yellow ink. The storage unit stores a second offset time T2. During adjustment printing, the control unit 1 makes a reference upstream-side head, which is the upstream-side head 7 in a reference line head, print as the adjustment chart 9 a third line L3, which is a straight line along the main scanning direction. The control unit 1 makes the reference upstream-side head print a plurality of third lines L3 at equal intervals. The control unit 1 makes a yellow upstream-side head 7, which is the upstream-side head 7 in a yellow line head 6Y, print as the adjustment chart 9 a fourth line L4, which is a straight line along the main scanning direction and which is paired with the third line L3. For each combination of the third and fourth lines L3 and L4, the control unit 1 displaces the position in the sub scanning direction of (the timing of ink ejection for) the fourth line L4 corresponding to the third line L3. Based on the combination, entered on the operation panel 3, of the third and fourth lines L3 and L4 with the smallest deviation, the control unit 1 recognizes the direction and the amount of deviation between the printing positions of the reference upstream-side head and the yellow upstream-side head 7 in the sub scanning direction. The control unit 1 makes the reference upstream-side head print as the adjustment chart 9 a fifth line L5, which is a straight line along the main scanning direction. The control unit 1 makes the reference upstream-side head print a plurality of fifth lines L5 at equal intervals. The control unit 1 makes the nozzles 61 in the overlapping portion 6*a* of the reference upstream-side head print the fifth line L5. The control unit 1 makes a yellow downstream-side head 8, which is the downstream-side head 8 in the yellow line head 6Y, print as the adjustment chart 9 a sixth line L6, which is a straight line along the main scanning direction and which is paired with the fifth line L5. The control unit 1 makes the nozzles 61 in the overlapping portion 6*a* of the yellow downstream-side head 8 print the sixth line L6. For each combination of the fifth and sixth lines L5 and L6, the control unit 1 displaces the position in the sub scanning direction of (the timing of ink ejection for) the sixth line L6 corresponding to the fifth line L5. Based on the combination, entered on the operation panel 3, of the fifth and sixth lines L5 and L6 with the smallest deviation, the control unit 1 recognizes the direction and the amount of deviation between the printing positions of the reference upstream-side head and the yellow downstream-side head 8 in the sub scanning direction. Based on the results of recognition, the control unit 1 determines the direction and the amount of deviation in the sub scanning direction between the printing positions of the same line printed by the yellow upstream-side head 7 and the yellow downstream-side head 8. Based on the determined direction and amount of deviation between the yellow upstream-side head 7 and the yellow downstream-side head 8, the control unit 1 corrects the first offset time T1 such that the printing positions of the same line coincide in the sub scanning direction between the yellow upstream-side head 7 and the yellow downstream-side head 8.

On a white sheet, a part printed in yellow is difficult to see. An adjustment chart 9 for adjustment with yellow ink can be difficult to read. This can be overcome by allowing a check for deviations of the printing positions of the yellow upstream-side head 7 and the yellow downstream-side head 8 in the sub scanning direction with respect to lines printed by the reference line head. Using the ink of the reference line head in combination with yellow ink makes it easy to recognize a combination with coincident positions in the sub scanning direction. Moreover, in a combination with coincident positions in the sub scanning direction, the fifth and sixth lines L5 and L6 overlap partly. The color resulting from the ink of the reference line head mixing with yellow ink makes it easy to recognize a combination with coincident positions in the sub scanning direction. It is possible to print an adjustment chart 9 that allows easy recognition of a combination of lines with coincident positions in the sub scanning direction. It is possible to accurately recognize the amount and the direction of deviation, and thus to accurately correct the first offset time T1 (ejection time lag) so as to eliminate the deviation.

The reference line head is a line head 6 that is located next to the yellow line head 6Y. The longer the distance between the reference line head and the yellow line head 6Y, the stronger the effect of a factor that causes variation of the sheet conveying speed. Variation of the sheet conveying speed makes it difficult to accurately recognize the amount and the direction of deviation in printing position. This can be overcome by taking as the reference line head a line head 6 close to the yellow line head 6Y. It is possible to print the adjustment chart 9 before the sheet conveying speed varies. It is possible to accurately recognize the amount and the direction of deviation. It is possible to accurately correct the first offset time T1 (ejection time lag) so as to eliminate the deviation.

The operation panel 3 accepts setting of the number of nozzles 61 used among the nozzles 61 in the overlapping portion 6*a* of the upstream-side head 7. The control unit 1 makes the set number of nozzles 61 among the nozzles 61 in the overlapping portion 6*a* of the upstream-side head 7 print the adjustment chart 9. The adjustment chart 9 is printed using the nozzles 61 in the overlapping portions 6*a* of the upstream-side and downstream-side heads 7 and 8. For a combination of lines at the same position in the sub scanning direction, the upstream-side and downstream-side heads 7 and 8 both eject ink to the same pixels (dots). Bleeding ink can make it difficult to recognize the combination with the closest positions in the sub scanning direction. With this configuration, it is possible to set the range of the nozzles 61 that are used among the nozzles 61 in the overlapping portion 6*a* of the upstream-side head 7. It is possible to limit the use of the nozzles 61 in the overlapping portion 6*a* of the upstream-side head 7 to avoid excessive ink bleeding.

The operation panel 3 accepts setting of the number of nozzles 61 used among the nozzles 61 in the overlapping portion 6*a* of the downstream-side head 8. The control unit 1 makes the set number of nozzles 61 among the nozzles 61 in the overlapping portion 6*a* of the downstream-side head 8 print the adjustment chart 9. It is possible to set the range of the nozzles 61 that are used among the nozzles 61 in the overlapping portion 6*a* of the downstream-side head 8. It is possible to limit the use of the nozzles 61 in the overlapping portion 6*a* of the downstream-side head 8 to avoid excessive ink bleeding.

The description given above of embodiments of the present disclosure is in no way meant to limit the scope of the present disclosure; the present disclosure can be implemented with any modifications made without departing from the spirit of the present disclosure.

For example, the embodiment described above deals with an example where, based on entry on the operation panel 3, the control unit 1 recognizes the combination of the first and second lines L1 and L2 with the smallest deviation. Instead, the control unit 1 may recognize the combination of the first and second lines L1 and L2 with the smallest deviation based on image data obtained by reading the adjustment chart 9. In that case, the inkjet recording apparatus may include an image reading device. A person in charge of adjustment sets a print result of the adjustment chart 9 on the image reading device. The control unit 1 makes the image reading device read the print result of the adjustment chart 9. The control unit 1 recognizes, out of the lines included in the image data obtained through the reading, a combination of the first and second lines L1 and L2 forming a straight line as the combination with the smallest deviation. In this way, it is possible to automatically recognize the combination with a small deviation as well as the amount and the direction of deviation.

For example, the modified example described above deals with an example where, based on entry on the operation panel 3, the control unit 1 recognizes the combination of the third and fourth lines L3 and L4 with the smallest deviation, and deals with an example where, based on entry on the operation panel 3, the control unit 1 recognizes the combination of the fifth and sixth lines L5 and L6 with the smallest deviation. Instead, the control unit 1 may recognize the combination of the third and fourth lines L3 and L4 with the smallest deviation based on image data obtained by reading the adjustment chart 9. Likewise, the control unit 1 may recognize the combination of the fifth and sixth lines L5 and L6 with the smallest deviation based on image data obtained by reading the adjustment chart 9. In that case, the inkjet recording apparatus may include an image reading device. A person in charge of adjustment sets a print result of the adjustment chart 9 on the image reading device. The control unit 1 makes the image reading device read the print result of the adjustment chart 9. The control unit 1 recognizes, out of the lines included in the image data obtained through the reading, a combination of the third and fourth lines L3 and L4 forming a straight line as the combination with the smallest deviation. Likewise, the control unit 1 recognizes, out of the lines included in the image data obtained through the reading, a combination of the fifth and sixth lines L5 and L6 forming a straight line as the combination with the smallest deviation. In this way, it is possible to automatically recognize the combination with a small deviation as well as the amount and the direction of deviation.

What is claimed is:

1. An inkjet recording apparatus comprising:

a sheet conveying unit that conveys a sheet;

a storage unit that stores a first offset time;

a line head that ejects ink onto the sheet conveyed by the sheet conveying unit, thereby to perform printing; and a control unit that controls ejection of ink from the line head, wherein the line head includes an upstream-side head and a downstream-side head, the upstream-side head is located on an upstream side of the downstream-side head in a sub scanning direction, the upstream-side and downstream-side heads each include a plurality of nozzles arrayed in a main scanning direction, adjacent ones of the upstream-side and downstream-side heads are fitted to have overlapping portions in which a plurality of nozzles arranged in respective end portions of the heads overlap as seen from the sub scanning direction, during regular printing in which printing is performed based on image data, the control unit after the upstream-side head prints a line, when the first offset time passes, makes the downstream-side head print a same line in the sub scanning direction and makes only either the nozzles in the overlapping portion of the upstream-side head or the nozzles in the overlapping portion of the downstream-side head eject ink, and during adjustment printing in which an adjustment chart for adjustment of printing positions of the upstream-side and downstream-side heads in the sub scanning direction is printed, the control unit makes the upstream-side head print as the adjustment chart a first line, the first line being a straight line along the main scanning direction, makes the upstream-side head print a plurality of the first lines at equal intervals, makes the nozzles in the overlapping portion of the upstream-side head print the first line, makes the downstream-side head print as the adjustment chart a second line, the second line being a straight line along the main scanning direction and being paired with the first line, makes the nozzles in the overlapping portion of the downstream-side head print the second line, and for each combination of the first and second lines, displaces a position in the sub scanning direction of the second line corresponding to the first line, the inkjet recording apparatus further comprises a plurality of the line heads that eject ink of different colors, one of the line heads elects yellow ink, the storage unit stores a second offset time, and during the adjustment printing, the control unit makes a reference upstream-side head, which is the upstream-side head in a reference line head, print as the adjustment chart a third line, the third line being a straight line along the main scanning direction makes the reference upstream-side head print a plurality of the third lines at equal intervals, makes a yellow upstream-side head, which is the upstream-side head in a yellow line head among the line heads, print as the adjustment chart a fourth line, the fourth line being a straight line along the main scanning direction and being paired with the third line, for each combination of the third and fourth lines, displaces a position in the sub scanning direction of the fourth line corresponding to the third line, based on the combination of the third and fourth lines with a smallest deviation, recognizes a direction and an amount of deviation between printing positions of the reference upstream-side head and the yellow upstream-side head in the sub scanning direction, makes the reference upstream-side head print as the adjustment chart a fifth line, the fifth line being a straight line along the main scanning direction, makes the reference upstream-side head print a plurality of the fifth lines at equal intervals, makes the nozzles in the overlapping portion of the reference upstream-side head print the fifth line, makes a yellow downstream-side head, which is the downstream-side head in the yellow line head, print as the adjustment chart a sixth line, the sixth line being a straight line along the main scanning direction and being paired with the fifth line, makes the nozzles in the overlapping portion of the yellow downstream-side head print the sixth line, for each combination of the fifth and sixth lines, displaces a position in the sub scanning direction of the sixth line corresponding to the fifth line, based on the combination of the fifth and sixth lines with a smallest deviation, recognizes a direction and an amount of deviation between the printing positions of the reference upstream-side head and the yellow downstream-side head in the sub scanning direction, based on results of recognition, determines a direction and an amount of deviation in the sub scanning direction between printing positions of a same line printed by the yellow upstream-side head and the yellow downstream-side head, and based on the determined direction and amount of deviation between the yellow upstream-side head and the yellow downstream-side head, corrects the first offset time such that the printing positions of the same line coincide in the sub scanning direction between the yellow upstream-side head and the yellow downstream-side head.

2. The inkjet recording apparatus according to claim 1, wherein the control unit, based on the combination of the first and second lines with a smallest deviation, recognizes a direction and an amount of deviation in the sub scanning direction, and based on the recognized direction and amount of deviation, corrects the first offset time such that printing positions of a same line coincide in the sub scanning direction between the upstream-side and downstream-side heads.

3. The inkjet recording apparatus according to claim 1, comprising a plurality of the line heads that eject ink of different colors, wherein during the adjustment printing, the control unit makes each of the line heads print the adjustment chart, and adjusts the first offset time for each of the line heads.

4. The inkjet recording apparatus according to claim 1, wherein the reference line head is a line head among the line heads that is located next to the yellow line head.

5. An inkjet recording apparatus comprising:

a sheet conveying unit that conveys a sheet;

a storage unit that stores a first offset time;

a line head that ejects ink onto the sheet conveyed by the sheet conveying unit, thereby to perform printing; and a control unit that controls ejection of ink from the line head, wherein the line head includes an upstream-side head and a downstream-side head, the upstream-side head is located on an upstream side of the downstream-side head in a sub scanning direction, the upstream-side and downstream-side heads each include a plurality of nozzles arrayed in a main scanning direction, adjacent ones of the upstream-side and downstream-side heads are fitted to have overlapping portions in which a plurality of nozzles arranged in respective end portions of the heads overlap as seen from the sub scanning direction, during regular printing in which printing is performed based on image data, the control unit after the upstream-side head prints a line, when the first offset time passes, makes the downstream-side head print a same line in the sub scanning direction and makes only either the nozzles in the overlapping portion of the upstream-side head or the nozzles in the overlapping portion of the downstream-side head elect ink, and during adjustment printing in which an adjustment chart for adjustment of printing positions of the upstream-side and downstream-side heads in the sub scanning direction is printed, the control unit makes the upstream-side head print as the adjustment chart a first line, the first line being a straight line along the main scanning direction, makes the upstream-side head print a plurality of the first lines at equal intervals, makes the nozzles in the overlapping portion of the upstream-side head print the first line, makes the downstream-side head print as the adjustment chart a second line, the second line being a straight line along the main scanning direction and being paired with the first line, makes the nozzles in the overlapping portion of the downstream-side head print the second line, and for each combination of the first and second lines, displaces a position in the sub scanning direction of the second line corresponding to the first line, the ink jet recording apparatus further comprising an operation panel that accepts setting of a number of nozzles used among the nozzles in the overlapping portion of the upstream-side head, wherein the control unit makes the set number of nozzles among the nozzles in the overlapping portion of the upstream-side head print the adjustment chart.

6. The inkjet recording apparatus according to claim 5, wherein the control unit, based on the combination of the first and second lines with a smallest deviation, recognizes a direction and an amount of deviation in the sub scanning direction, and based on the recognized direction and amount of deviation, corrects the first offset time such that printing positions of a same line coincide in the sub scanning direction between the upstream-side and downstream-side heads.

7. The inkjet recording apparatus according to claim 5, comprising a plurality of the line heads that eject ink of different colors, wherein during the adjustment printing, the control unit makes each of the line heads print the adjustment chart, and adjusts the first offset time for each of the line heads.

8. An inkjet recording apparatus comprising:

a sheet conveying unit that conveys a sheet;

a storage unit that stores a first offset time;

a line head that ejects ink onto the sheet conveyed by the sheet conveying unit, thereby to perform printing; and a control unit that controls election of ink from the line head, wherein the line head includes an upstream-side head and a downstream-side head, the upstream-side head is located on an upstream side of the downstream-side head in a sub scanning direction, the upstream-side and downstream-side heads each include a plurality of nozzles arrayed in a main scanning direction, adjacent ones of the upstream-side and downstream-side heads are fitted to have overlapping portions in which a plurality of nozzles arranged in respective end portions of the heads overlap as seen from the sub scanning direction, during regular printing in which printing is performed based on image data, the control unit after the upstream-side head prints a line, when the first offset time passes, makes the downstream-side head print a same line in the sub scanning direction and makes only either the nozzles in the overlapping portion of the upstream-side head or the nozzles in the overlapping portion of the downstream-side head eject ink, and during adjustment printing in which an adjustment chart for adjustment of printing positions of the upstream-side and downstream-side heads in the sub scanning direction is printed, the control unit makes the upstream-side head print as the adjustment chart a first line, the first line being a straight line along the main scanning direction, makes the upstream-side head print a plurality of the first lines at equal intervals, makes the nozzles in the overlapping portion of the upstream-side head print the first line, makes the downstream-side head print as the adjustment chart a second line, the second line being a straight line along the main scanning direction and being paired with the first line, makes the nozzles in the overlapping portion of the downstream-side head print the second line, and for each combination of the first and second lines, displaces a position in the sub scanning direction of the second line corresponding to the first line, the ink jet recording apparatus further comprising an operation panel that accepts setting of a number of nozzles used among the nozzles in the overlapping portion of the downstream-side head, wherein the control unit makes the set number of nozzles among the nozzles in the overlapping portion of the downstream-side head print the adjustment chart.

9. The inkjet recording apparatus according to claim 8, wherein the control unit, based on the combination of the first and second lines with a smallest deviation, recognizes a direction and an amount of deviation in the sub scanning direction, and based on the recognized direction and amount of deviation, corrects the first offset time such that printing positions of a same line coincide in the sub scanning direction between the upstream-side and downstream-side heads.

10. The inkjet recording apparatus according to claim 8, comprising a plurality of the line heads that eject ink of different colors, wherein during the adjustment printing, the control unit makes each of the line heads print the adjustment chart, and adjusts the first offset time for each of the line heads.

* * * * *